US006315257B1

(12) United States Patent
Fennesz

(10) Patent No.: US 6,315,257 B1
(45) Date of Patent: Nov. 13, 2001

(54) FASTENING SYSTEM FOR HEAT EXCHANGERS, AND LINING

(76) Inventor: Manfred Fennesz, Hartlebengasse 1-17/51/1, A-1220 Vienna (AT)

( * ) Notice: Subject to any disclaimer, the term of this patent is extended or adjusted under 35 U.S.C. 154(b) by 0 days.

(21) Appl. No.: 09/269,293

(22) PCT Filed: Sep. 24, 1997

(86) PCT No.: PCT/EP97/05248

§ 371 Date: Mar. 24, 1999

§ 102(e) Date: Mar. 24, 1999

(87) PCT Pub. No.: WO98/13651

PCT Pub. Date: Apr. 2, 1998

(30) Foreign Application Priority Data

Sep. 24, 1996 (AT) ..... 1687/96

(51) Int. Cl.[7] ..... F24H 9/06
(52) U.S. Cl. ..... 248/232; 248/209
(58) Field of Search ..... 248/232, 209, 248/200; 165/67

(56) References Cited

U.S. PATENT DOCUMENTS

| | | | | |
|---|---|---|---|---|
| 3,121,467 | * | 2/1964 | Bryant | 248/232 |
| 3,152,637 | * | 10/1964 | Ronn et al. | 248/232 |
| 3,398,786 | * | 8/1968 | McNabney | 248/232 |
| 4,196,774 | * | 4/1980 | Hoffman | 248/232 |
| 4,262,741 | * | 4/1981 | Rothenbucher | 248/232 |
| 4,480,787 | * | 11/1984 | Okumura | 248/232 |
| 5,544,714 | * | 8/1996 | May et al. | 248/232 |

* cited by examiner

*Primary Examiner*—Ramon O. Ramirez
*Assistant Examiner*—J. DeLuca

(57) ABSTRACT

A room temperature equalizing system has a mounting (2), a heat exchanger (12) and a cover (10). The mounting (2) comprises an U-shaped support which on the one hand receives the heat exchanger (12) and on the other hand carries the cover (10) on its U-shaped, upward projecting legs. The mounting (2) can be inserted by its bottom side on a rail (1) and laterally slide on said rail. This new system makes mounting easier and provides a heating-cooling system with a diversity of uses.

15 Claims, 19 Drawing Sheets

8
17a
4d
4
18
17f
17h
4f 10b
18d
18
8
17a
17
12
22
4
18
19
10
23
24
4f
2
8
7
7
8a
5
13
14
9

Fig. 11A
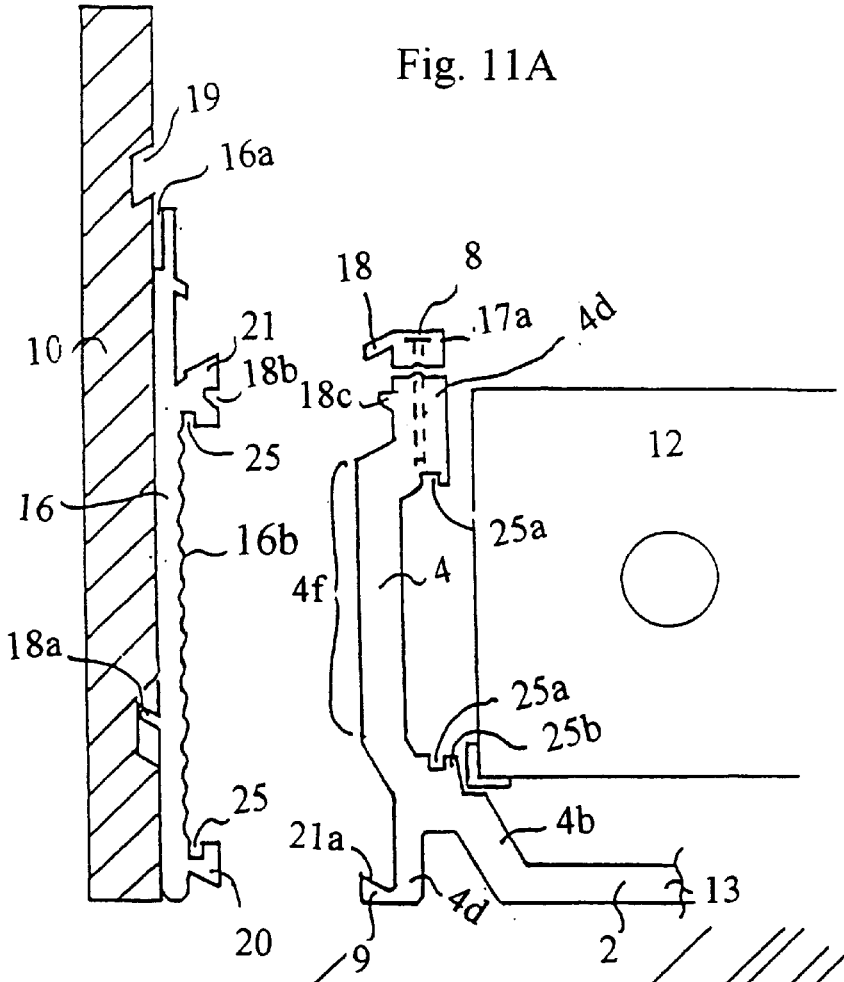
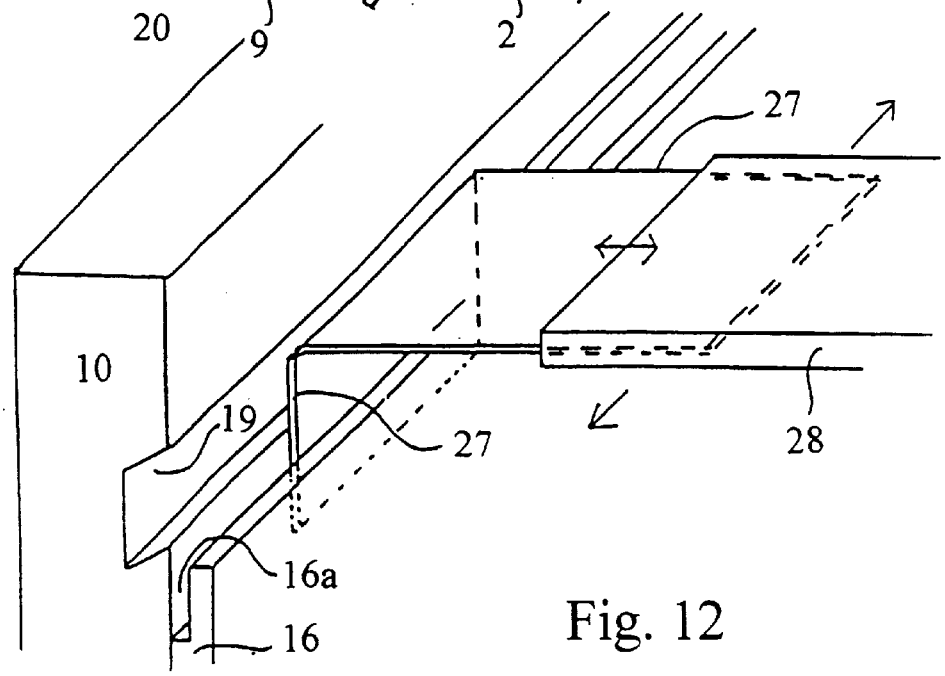
Fig. 12

16
26
26a
29
16
26
26a 16
26
29
16

16
25

26
16
26
25'
16

13h
8e
13a
8g
13a
13c
13h
13b 13b
10s
1
3
5
8
8a
6
1

8a
6
8
8e
8f
6
8
8e
8f
8a
1

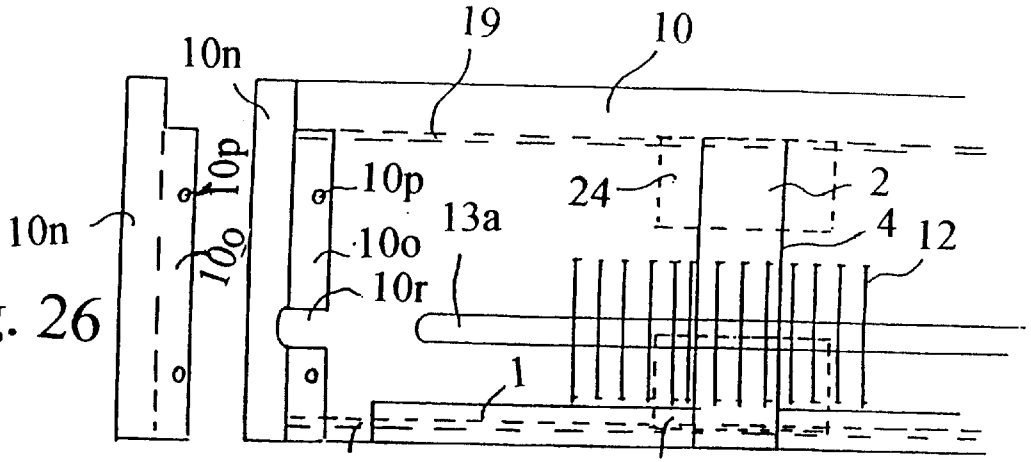
Fig. 26
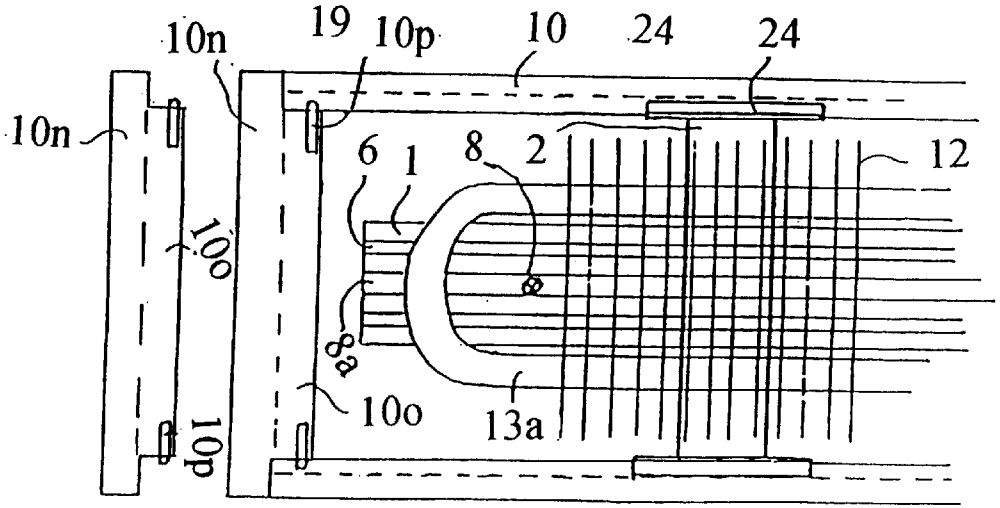
Fig. 27
Fig 28A
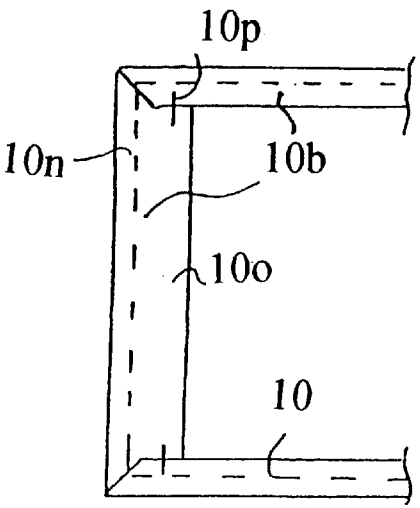

115
116
114
115
116
114

117
116
114
116

117
10
8g
116

FASTENING SYSTEM FOR HEAT EXCHANGERS, AND LINING

The invention relates to a fastening system for heat exchangers or pieces of furniture and a lining. For many purposes, especially for shielding from cold air in front of large windows or glazing extending down to the floor, for showcases, conservatories, verandahs, etc., radiators/convectors for floor-mounting or bracket-mounting on bases, etc. are used, which radiators/convectors are dimensioned to be as high or low as permitted by the circumstances or as desired. These heating elements are produced from iron, sheet metal and other materials.

WO 93/04321 describes an extensive thermostating apparatus in which a mounting element displaceable in the longitudinal direction owing to self-expansion is arranged between an arm and a cover.

The object of the present development is an elongated piece of furniture or heating or cooling element which can be lined in the same way as baseboard heating, for example with wood, modules, ceramic tiles, tiles, etc.

A desired heating system should be capable of being mounted substantially exactly in a line, possibly at various angles, and should consist of light individual parts. Furthermore, it should be possible to be able to produce such heating systems in larger/longer form in any desired combination, in particular in modular design.

The mounting for short to very long heat exchangers should in certain embodiments be movable, adjustable and adaptable. These systems should be capable of being mounted directly on the floor or a distance from the floor or on brackets and should be both produced from individual parts and capable of being mounted in a line. In the case of ceramic tiles and a tile lining, the support panel for the lining should consist of preferably heat-conducting material in order to transfer some of the heat from the heat exchanger to the ceramic tiles or tiles. All problems which may arise from the mounting of the lining made of a very wide range of materials, such as wood or the like, or stone, ceramic, tiles, etc., should be solved by this development.

Claim 1 indicates substantial elements of the novel development. The other claims describe further developments and alternatives to these. Further variants are evident from the Figures. The Figures show embodiments, which however do not restrict the scope of the invention.

FIG. 1A shows a cross-section through the structure of an elongated heating or cooling system in a possible, natural size. In this example with lining 10 (wood, etc.) on both sides and ventilation grille 11. Such heating systems are preferable mounted along a wall or window frontages. A lining 10 is provided on both sides. Also on the side which faces the wall/window and can also be seen from the outside through the window, etc., for example in the case of balconies, terraces, conservatories. The linings 10 on both sides may also serve as a support part for the ventilation grille 11 or at least for visually terminating said grille and for bounding both sides of the heat exchanger 12. A rail 1 (shaded) which is continuous or arranged in sections and has an extension 7 on both sides FIG. 1 shows a cross-section through the structure of an and grooves 6 and preferably at least one continuous channel 8*a* is fastened to the floor by, for example, a screw 8. The screw 8 is protected in the channel 8*a* and furthermore does not hinder the mechanical function of the rail 1 with the mounting part 2. The screw channel 8*a* may also be accommodated in the lower parts 4*b* of the mounting part 2. A U-shaped mounting part 2 which is arranged at intervals and open at the top and produced from metal or plastic—preferably by extrusion processes—has, formed on its lower part 4*b*, extensions 5 which are guided between the extensions 7 in the grooves 6 of the rail. elongated heating or cooling system.

FIG. 4 shows a continous rail with mounting parts pushed on.

FIG. 11A shows a left half of a mounting part with an inserted heat exchanger.

FIG. 12 shows a diagram of an upper part of a support panel with a lining according to FIGS. 11A and 11B.

Figure 20:
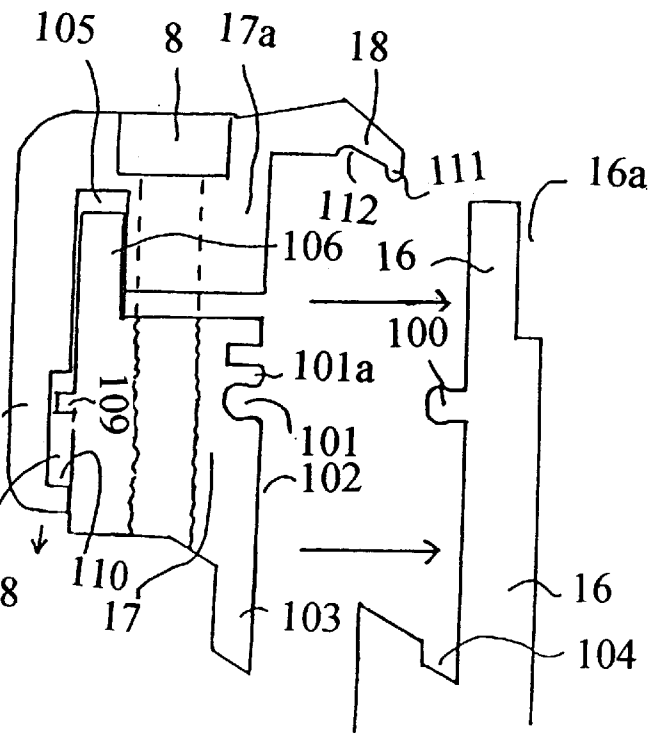
Figure 19:
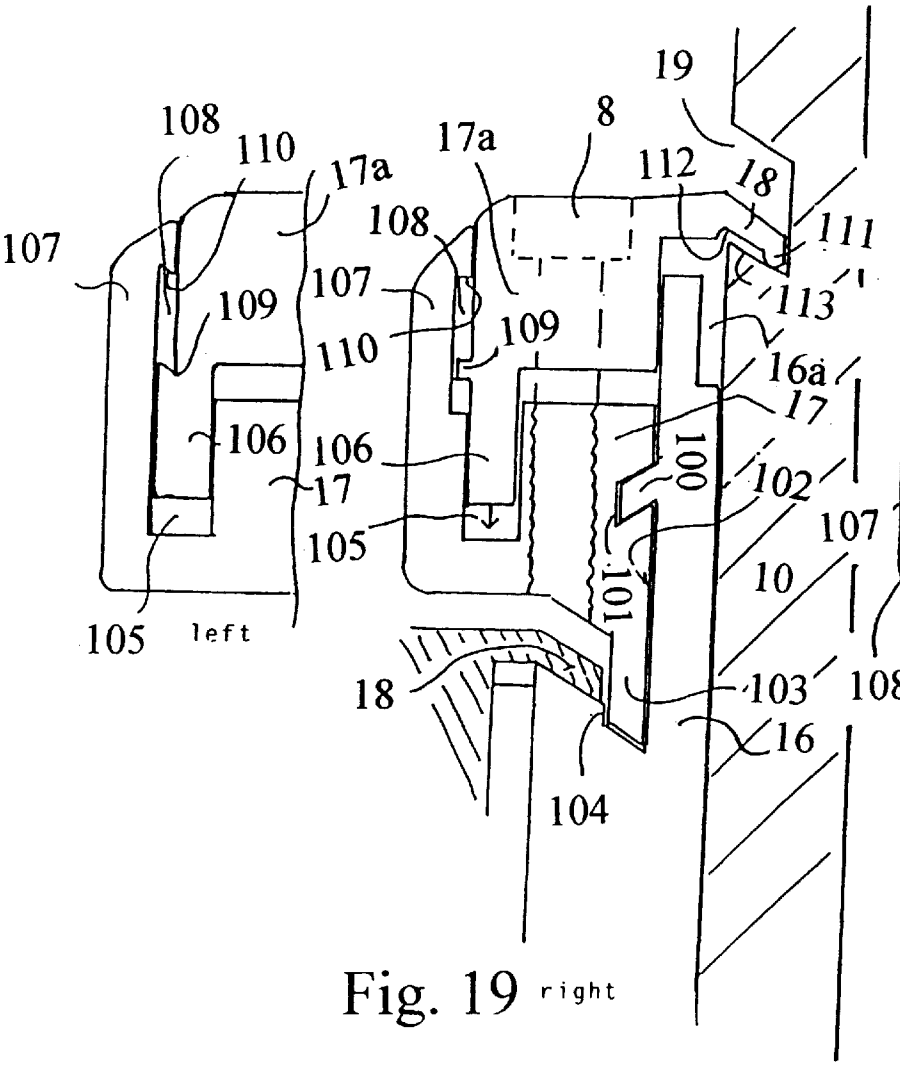
FIG. 19 shows a cross-section of a continous support panel and a two-part clamping part that is mounted at intervals.

FIG. 20 shwos a two-part clamping part of the embodiment of FIG. 19.

Figures 23, 24A, 24B, 24C:
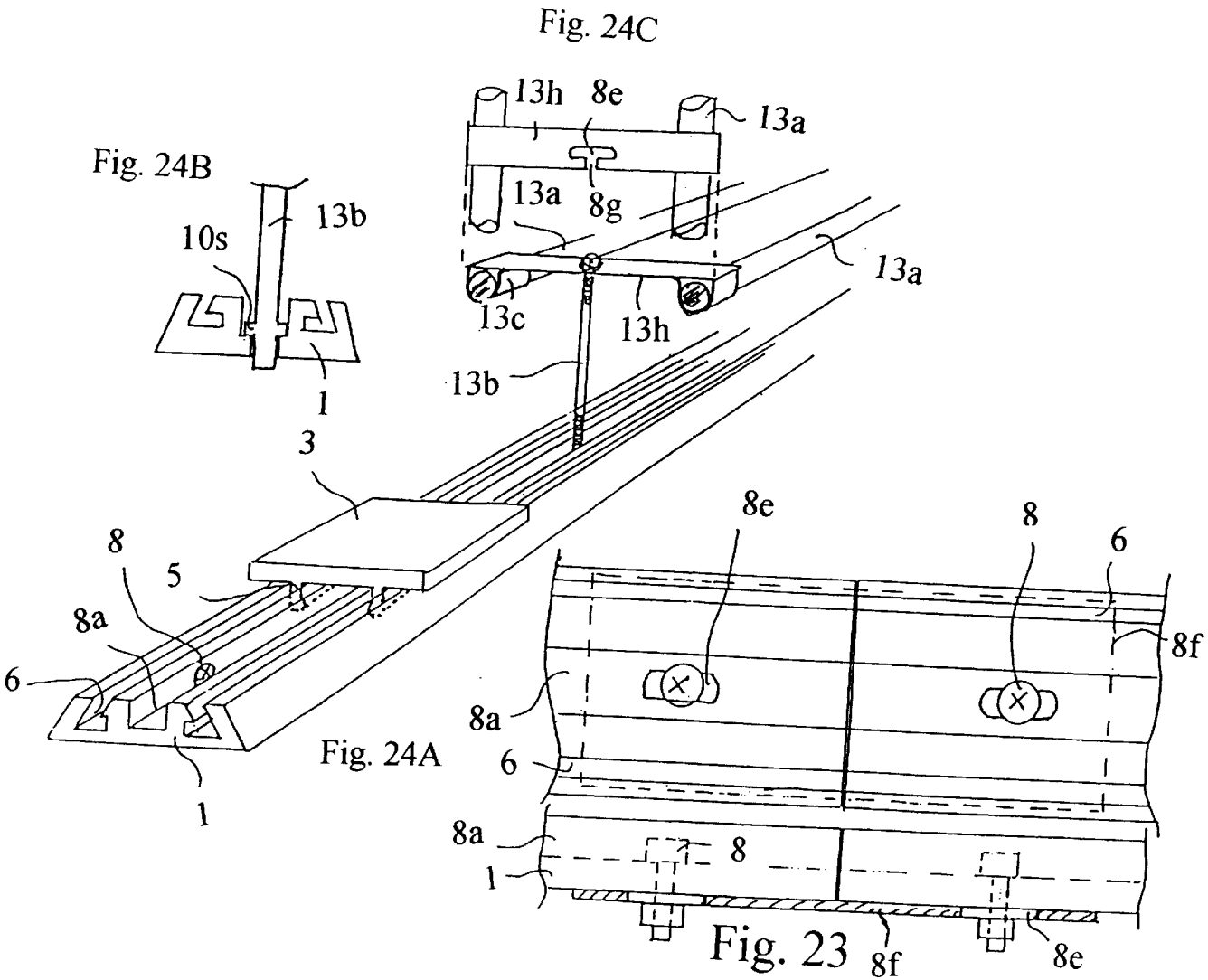

FIG. 23 shows a rail, viewed from above.

FIGS. 24A–24C show a rail that is fastened by screws.

Figures 25A, 25B:
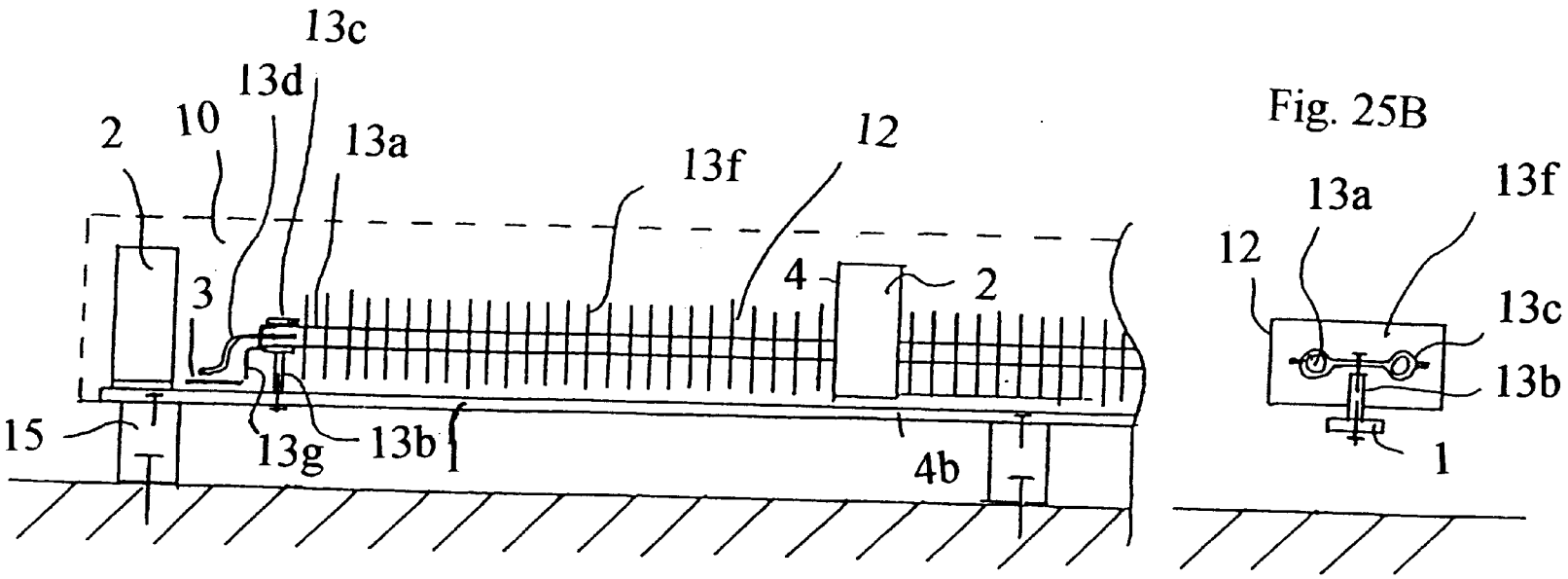

FIGS. 25A–25B show a heating system according to FIGS. 24A–24C, but without a support surface with extensions, in side view.

FIG. 26 shows a heating system according to the invention.

FIG. 27 shows the embodiment of FIG. 26, viewed from above.

Figure 28C:
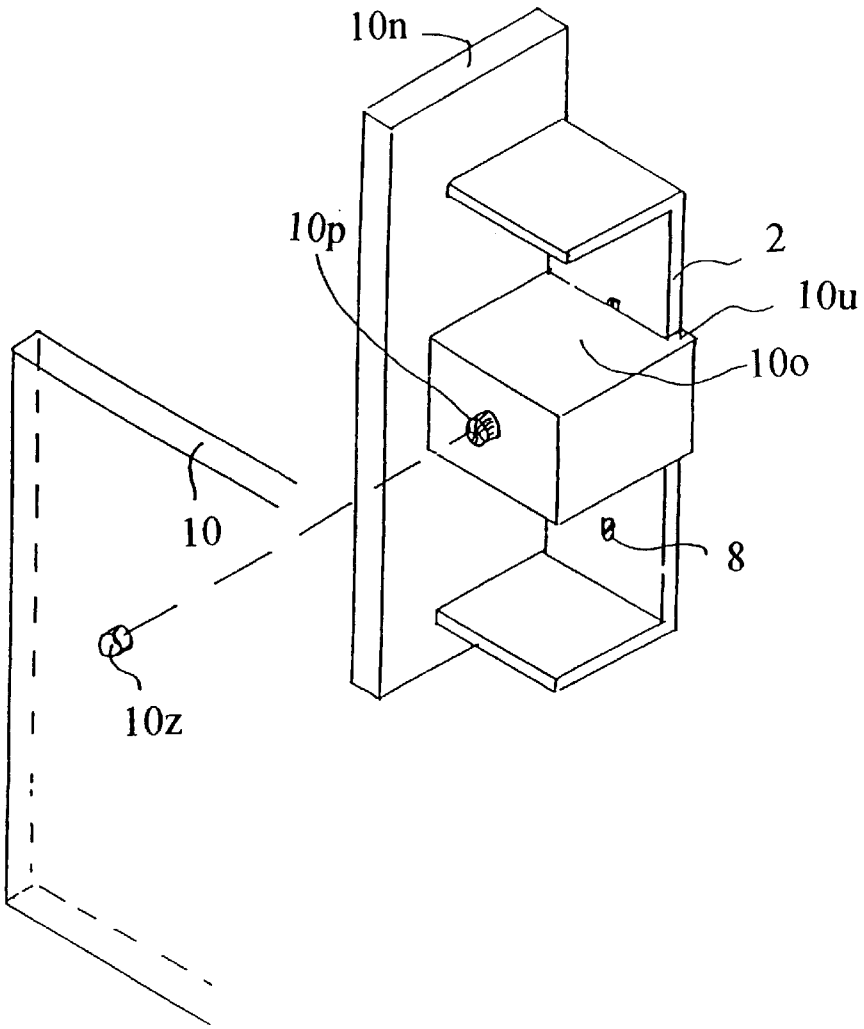
Figure 28B:
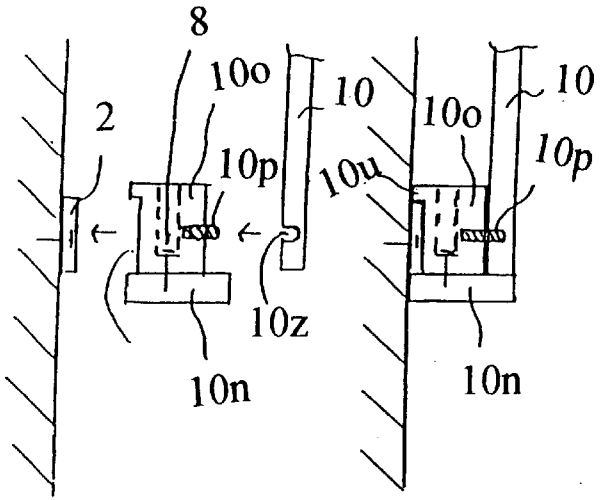

FIGS. 28A–28C show an embodiment according to FIG. 27.

Figures 29A, 29B, 29C:
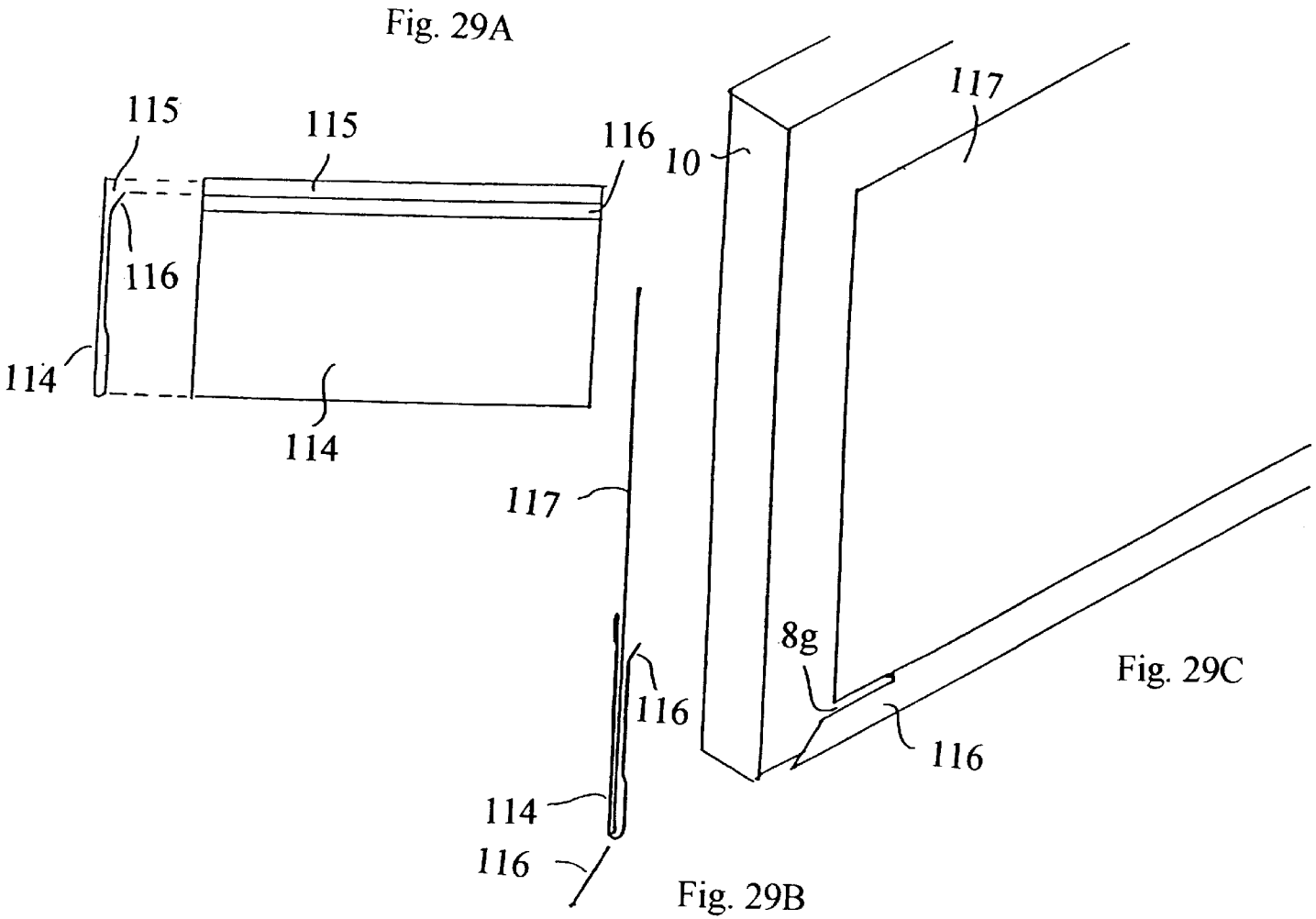

FIG. 29 shows a fastening part for pushing or snapping into grooves according to FIG. 11.

These extensions 7/5 and grooves 6 may have different shapes, including T-shaped, dovetail-shaped, etc. Thus, for example, a T-shaped extension 5 in the lower part 4*b* and a T-shaped groove 6 in the rail 1 are sufficient as a guide, or vice versa.

The rail 1 itself may also serve as extension 7 and be guided in a recess/groove 5*a* (FIG. 10) in the lower part 4*b*.

If the mounting part 2 can be lifted from the rail 1 and adjusted longitudinally, a fixing device is preferably mounted or the mounting part 2 can be fastened by screws or the like to the rail 1. The lower part 4*b* has a support surface 3 for a heat exchanger 12. Side parts 4 are formed on both sides of the lower part 4*b*. The object of these side parts 4 is to hold the lining 10 exactly by means of upper and lower fastening systems (not shown in this Figure).

The total structure of the heating system can be constructed exactly, light and virtually 100% straight owing to the linearly aligned rail 1 which also has sufficient strength and is also preferably produced in metal or plastic by the extrusion process. The mounting parts 2 are pushed onto the rail 1 at intervals—according to the position of the heat exchanger 12 and of the lining 10, for example every 60 cm. The mounting parts 2 can also be moved after the insertion or connection of the heat exchanger 12, according to the requirement for the lining parts 10 (butt joint). If the rail 1 is resilient, for example made of plastic, it is also possible to snap in the mounting parts 2, or vice versa.

The side parts 4 have extension parts 9 which are preferably formed in the same plane of the lower edge of the rail 1 and thus form a plane. The groove-extension joint, mounting part 2—rail 1, has a small amount of play. Thus, the mounting part can be moved on the rail 1 by lifting slightly, without the guide jamming or the extension parts 9 grinding on the floor. This embodiment is particularly suitable for floor mounting as well as for continuous bases, bases arranged at intervals and brackets. Even in the case of floor mounting, passages 15*a* can be arranged in the lining 10 on both sides or one side, so that air can also flow in from the side. The side parts 4 can be formed so that they can be pushed onto or mounted on the mounting part 2.

FIG. 1 shows a somewhat flat, band-shaped rail 1. It is of course also possible, or necessary in particular cases, to form the cross-sectional shape of the rail 1 to be, for example, rectangular, tetragonal, semicircular or upright. The extensions 7 of the rail 1, formed slanting in this case, may also be perpendicular, form a lateral strut and contribute to the stability of strip 1. A hole in the lower part 4*b*, in which a rail 1 is guided, is also possible in another embodiment.

A particular embodiment is formed so that at least the front side part 4, optionally also insertable displaceable or mountable on the lower part 4*b*, may also serve as a mounting for only one front lining 10, and that the rear side part 4 is formed for wall mounting and optionally also has a rail 1—mounting part 2 joint.

A particular embodiment is formed so that the rail 1 slants upward/inward (FIGS. 1A, 3), optionally in cooperation with the mounting part 2. A further particular embodiment is formed so that the lower part 4*b* has a mounting part 2 and a rail 1, between two support panels 16 or linings 10, having at least one extension or groove 6/5/7/5 a each, which engage one another and are longitudinally movable and that the lower part 4*b* formed to be at least 20% broader that the rail 1.

A further particular embodiment is formed so that the special features of all Figures described or all patent claims can be combined with one another.

Figure 1A:
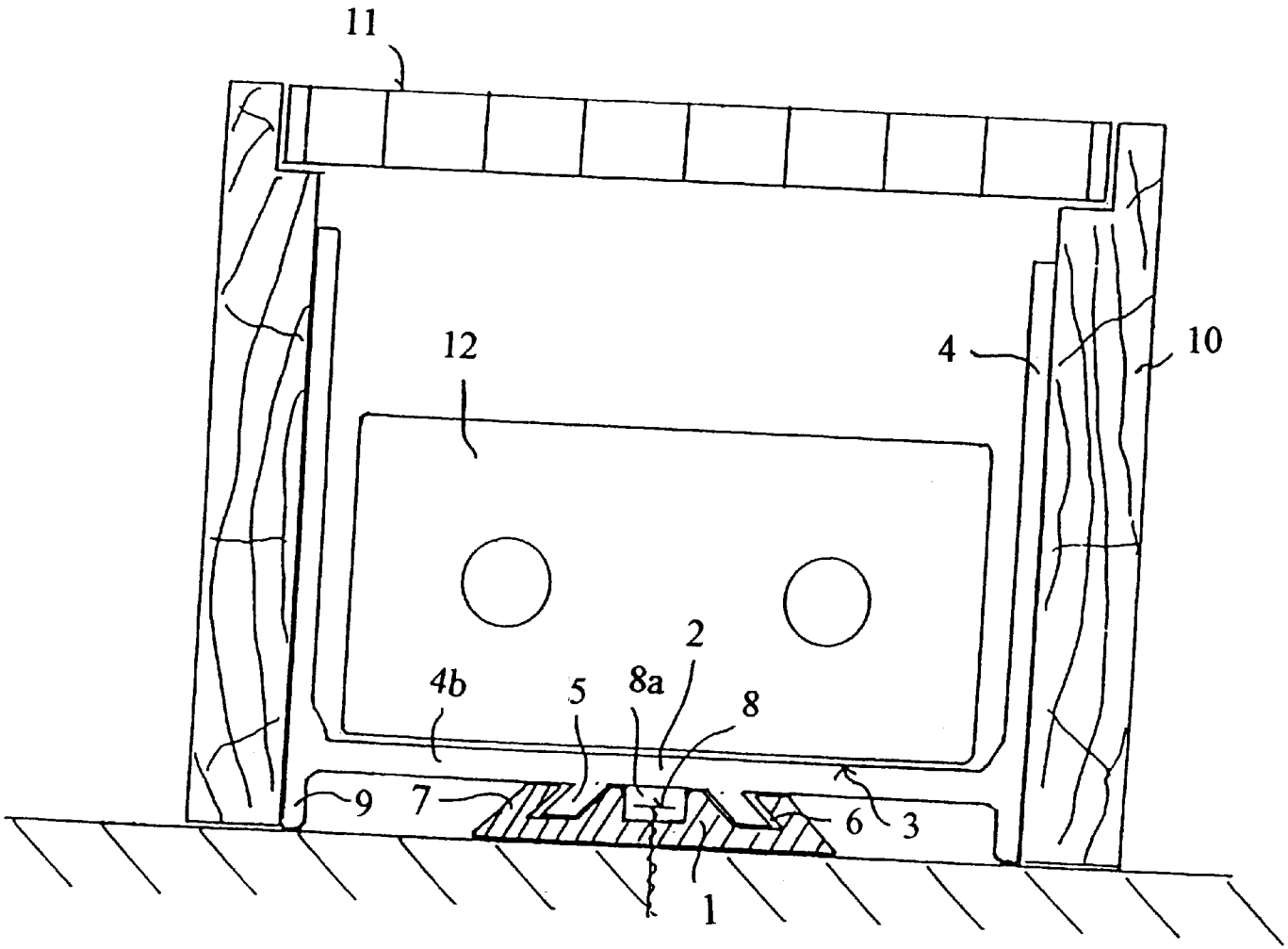
FIGS. 1B and 1C show an embodiment in which a rail is formed from U-shaped sheet metal.
Figures 1B, 1C:
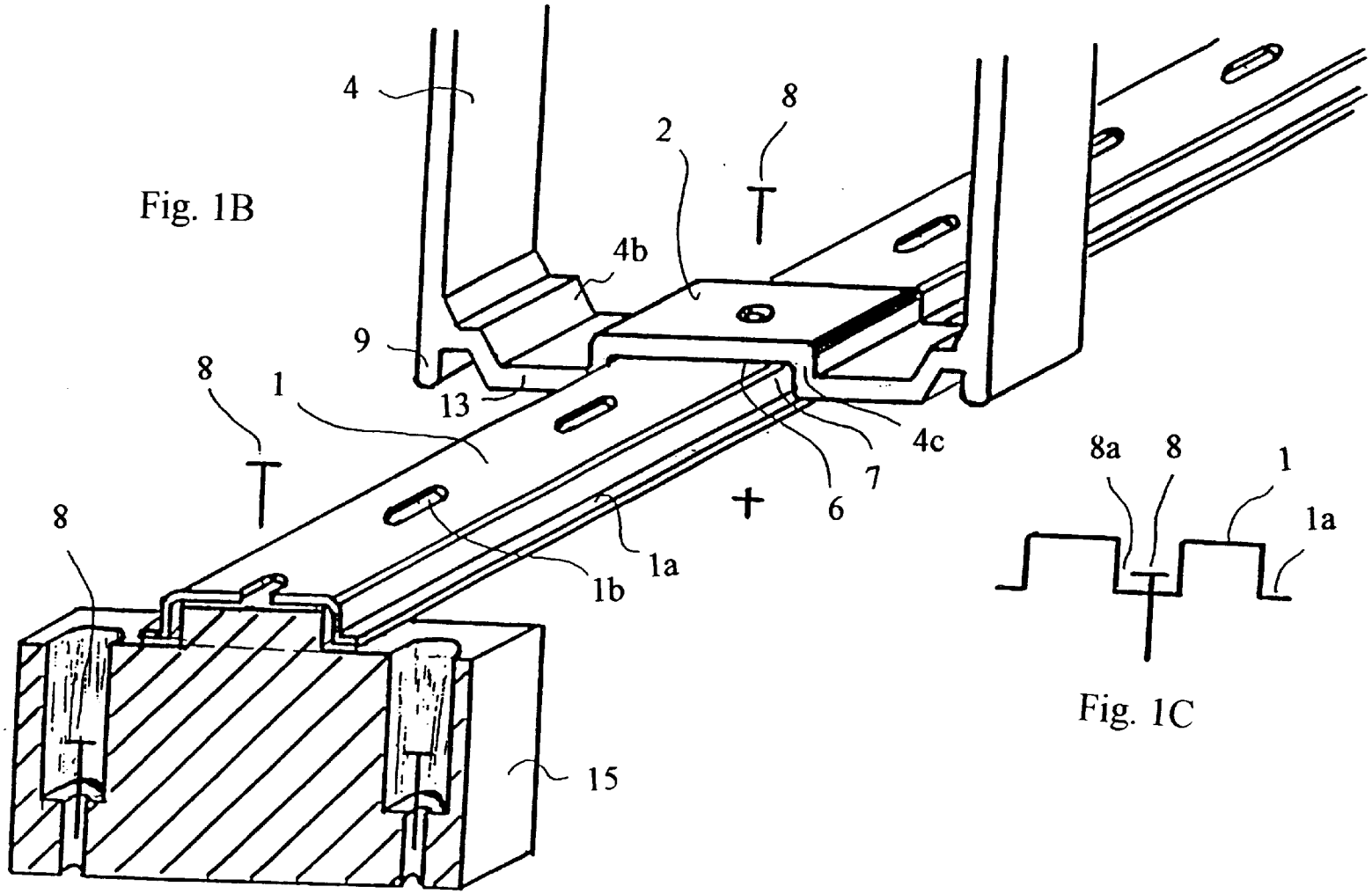

FIGS. 1B and 1C show an embodiment in which the rail 1 is formed from sheet metal to be U-shaped, with small feet 1*a* on both sides. The rail 1 preferably has holes 1*b* at intervals. The rail 1 is mounted on base 15 by means of screws etc. The rail 1 constitutes per se an extension 7 which comes to rest in a groove 6 in the mounting part 2 or lower part 4*b* (the groove 6 in this Figure is the recess between the pounding part 4*c*).

The screwing or anchoring with the mounting part 2 results in an exact transverse position of the mounting part 2. The mounting part 2 may also optionally have a slot, and slots in the rail 1 have a spacing such that fastening can take place in any region of the free rail. The rail 1 can also be used by placing it on its back. Of course, different forms of rails can be used, including those in which the slot is present in a channel, as shown in the diagram on the right. Fastening to the floor or a straight transverse base 15 can also be effected by means of screws via the support part 13, in which case the screws need not be countersunk.

Fastening can also be effected by clips via grooves or extensions of the rail 1 and/or of the mounting part 2. In a U-shaped rail 1 open at the top, the U-opening being designated as groove 6, a mounting part 2 having a downward-pointing extension 5 (formed as the groove 6 in FIG. 1A) can be guided and can be fastened by screw connections.

Simultaneously with the extension 5, support parts 13 can be formed on both sides or one side. Such mounting parts 2 in an embodiment having a groove 6 can also be mounted on a continuous base 15, optionally with passages 15*a*, it being possible for this base to have an extension 7 or for attachments to be applied. In the case of conventional elongated heating systems (for example baseboard heating systems), the front lining 10 or front support panel 16 is held between an upper and lower arm projecting away from the wall—floor/ceiling, by means of a rigid hook/extension on one arm and movable hook on the other arm. In the actual construction of a heating system and of a lining 10 and support panel 16 on both sides (front/back, optionally laterally) or support panel 16 and lining 10 and side linings on rigid side parts 4 by means of hooks at the bottom and a hook at the top, at least one hook is adjustably held or is held by a snap device.

The side parts 4 of the mounting part 2 are rigidly formed and can be formed integrally therewith or may also be mountable/pluggable.

The side parts 4, optionally also produced from sheet metal, with or without clamping device, may have, on the inside or outside, hooks, extensions, grooves, etc. or slots, blades, etc. Alternatively, they are formed as a sheath, and linings 10 or support panels 16 and linings 10 can be applied to, mounted on or pushed on continuously or at intervals by means of diametrically opposite fastening parts.

When employed in built-in systems, the sheath/slot embodiments of the slide parts are used for enclosing panels, preferably metal sheets, at a desired height from side part to side part, at least at the front. They thus form a convection channel. Preferably, however, these metal sheets are pushed in on both sides.

In another embodiment, a base 15 can be formed at intervals, arranged as rail 1. The rail 1 can also be in the form of a hollow profile, made of plastic or metal. A compact embodiment comprising wood or composite material is also possible.

The side parts 4 of the mounting part 2 hold or clamp lining parts 10 or metal sheets at a desired height which may also be several times higher than the side parts 4 themselves and thus form a convection channel, which is advantageous for achieving optimal heat output. In the case of metal sheets mounted between side parts, the grooves 25*a* can be used as a mounting. Additionally, however, a support panel 16 and a lining 10 or only a lining 10 may also be used. A particular embodiment is one in which the rail 1 has holes 1*b* from top to bottom, which are intended for additional convection and optionally for fastening mounting parts 2 to rails 1 (FIG. 1A).

Figure 2:
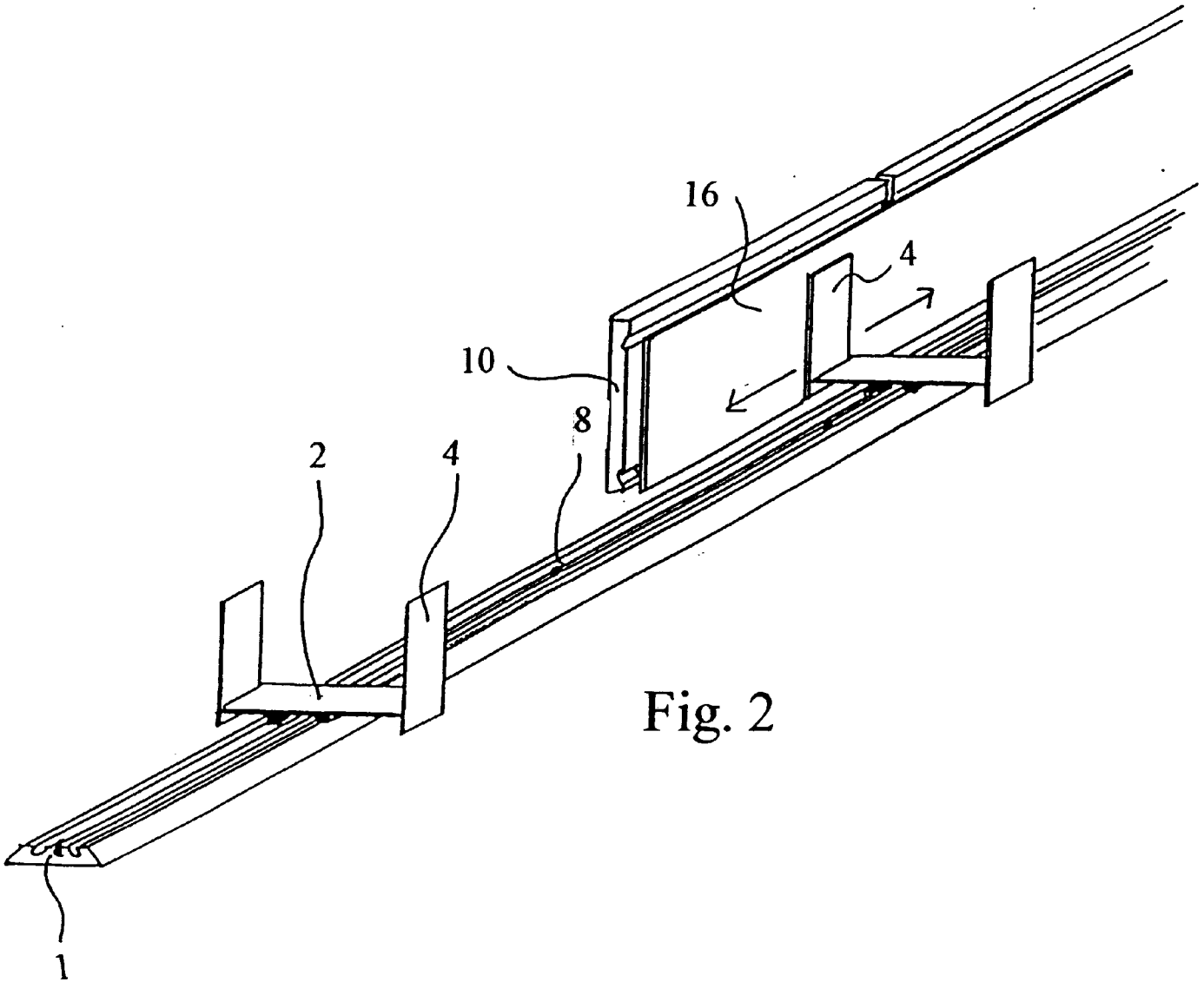
FIG. 2 shows a representation according to FIG. 1.

FIG. 2 shows a representation according to FIG. 1. A rail 1 is fastened to the floor by screws 8. Mounting parts 2 are pushed onto the rail 1. In this state of assembly, the heat exchanger 12 can be inserted and connected (not shown). A support panel 16 is mounted between the side part 4 of the mounting part 2 and a lining 10. This support panel 16 has an upper and lower device (not shown) for holding the lining 10.

Figure 5:
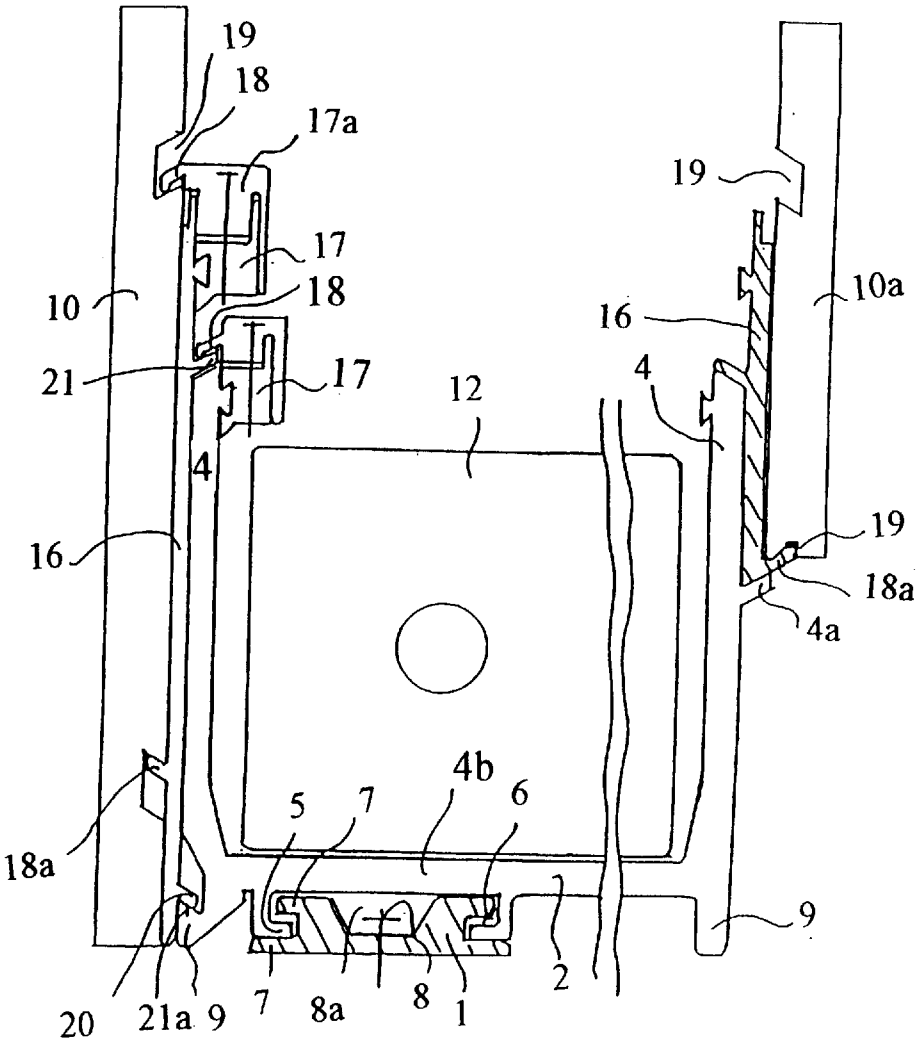
FIG. 5 shows an embodiment according to FIG. 3.

The support panel 16 is preferably produced from metal or plastic by the extrusion process. In an embodiment with metal, this support panel 16 absorbs the heat from the heat exchanger 12, partly by radiation, and transfers it to the lining 10 (marble, granite, etc.). The support panels 16 mounted on both sides are several times longer than the lining parts 10 and are themselves held by at least two mounting parts 2. Fastening parts for the support panel 16 are not shown in this Figure (FIG. 5). For receiving two heat exchangers 12 side by side, two mounting parts 2 are arranged side by side (or offset) on a rail 1; the lining 10 or support panel 16 can optionally be omitted between two mounting parts 2.

Figure 3:
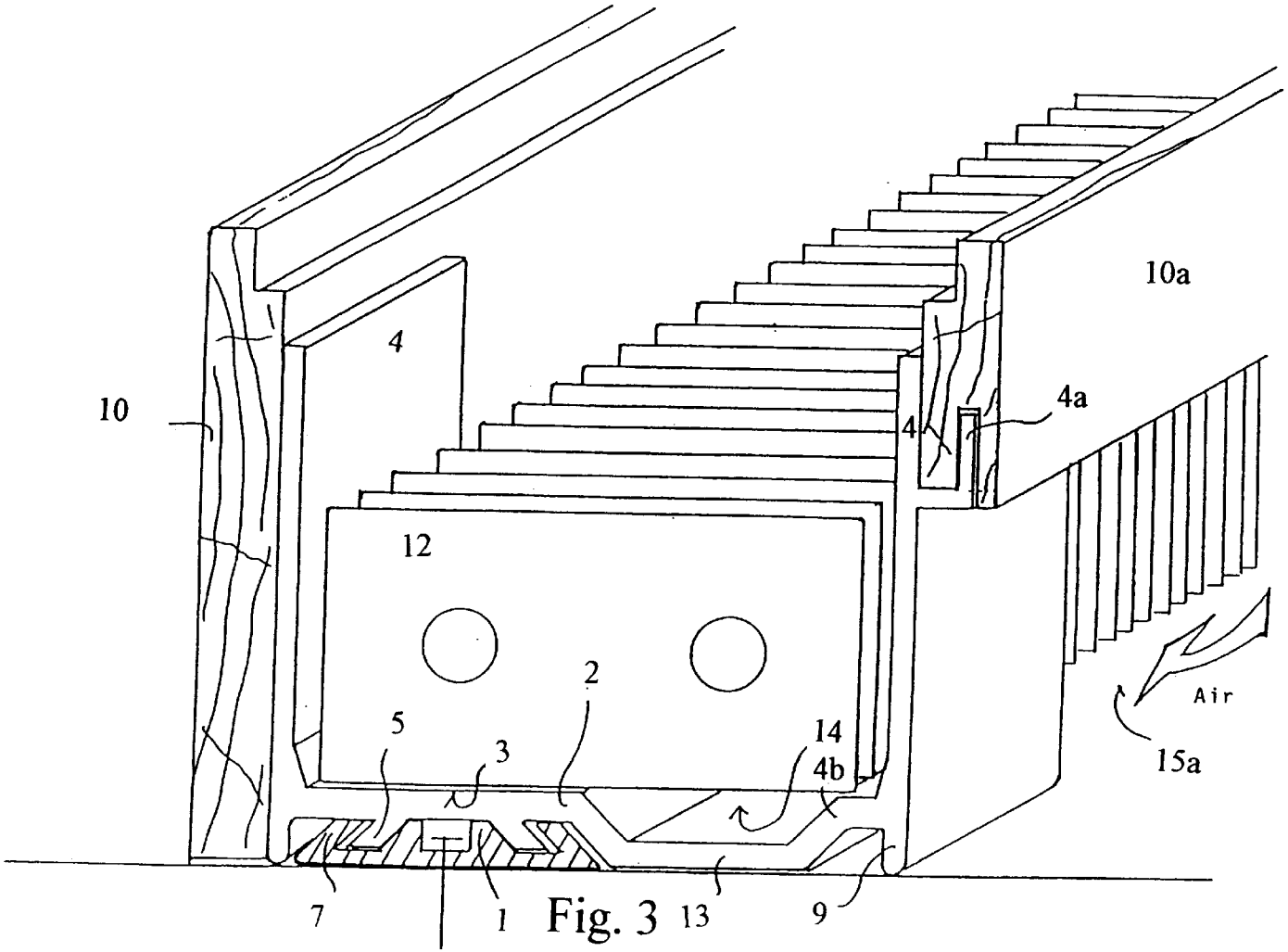
FIG. 3 shows the structure of a heating system according to FIGS. 1 and 2.

FIG. 3 shows the structure of a heating system according to FIGS. 1 and 2. Here, the rail 1 is mounted to the left side of the mounting part 2. In the right part of the mounting part 2, the lower part 4*b* extends downwards and forms a support part 13 of the same depth as the rail 1 and simultaneously a convection orifice 14 which is preferred for permitting better air circulation in the region of the mounting part 2. A claw 4*a* is formed from the right side part 4 and thus holds a lower lining 10*a* than the higher lining 10 on the left side. An elongated passage 15*a* forms on the right side, through which passage convection takes place and has better efficiency than the embodiment according to FIG. 1. Such an embodiment could, for example, take up descending, cold air near window surfaces.

Figure 4:
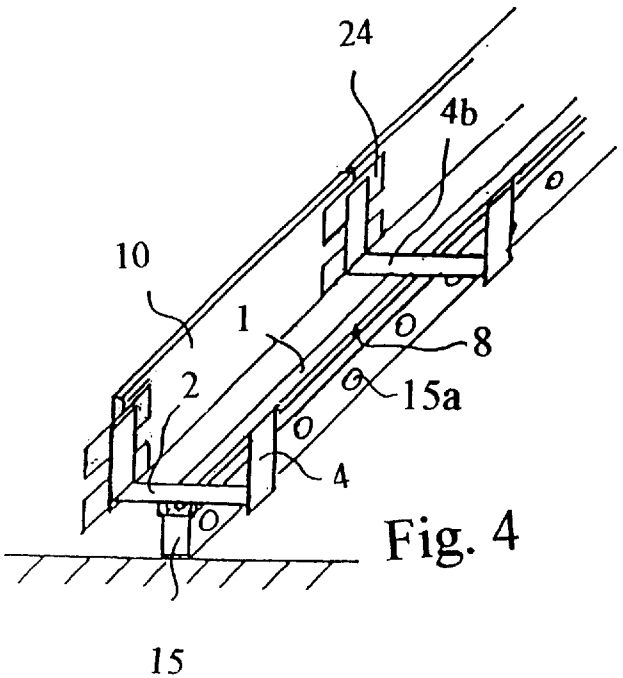

FIG. 4 shows a continuous rail 1 and mounting parts 2 pushed on. The rail 1 is mounted, by means of screws 8, on a continuous base 15 mounted on the floor. If required, the base 15 may have passages 15*a* of different shapes for convection.

Instead of continuous base 15, bases which are arranged at intervals and are bridged by the rail 1 may also be mounted. The rail 1 is formed to be so stable that the displaceably arranged mounting parts 2 can also be positioned between two bases 15 and nevertheless have the necessary stability. Another embodiment envisages a rail 1 which is formed in sections which are fastened on a continuous base 15 or at least two bases 15 or on the floor (FIGS. 1, 2, 3). The base 15, arranged at intervals, free or mounted on the floor, can also be formed transversely to the rail 1 and can optionally extend up to the lining 10 or beyond and form a support for the lining 10 and thus contribute to the stability of the entire construction.

Even in the case of a construction having a support panel 16 (FIGS. 2, 5, 11), the base 15 can be formed transversely to the rail 1, extend at least to the support panel 16 and be supported or rest there, as in the case of an embodiment according to FIG. 11A without a lining 10. In another embodiment, brackets too can extend up to the lining 10 or support plate 16 and be supported there. Furthermore, the base 15 can have at least one groove or at least one extension in which the rail 1 is guided so that the base 15 is tailored exactly to the lining 10.

Where there is a high heat requirement, it is also possible to mount two rails 1 side by side so that two mounting parts 2 are preferably connected to one another. The inner linings 10 can then optionally be dispensed with and the ventilation grille 11 bridges the two mounting parts 2. A base 15 is then preferably mounted transversely to the rails 1 and will be sufficiently deep to permit two rails 1 to be mounted. In this case, the mounting parts 2 can preferably be connected to the inner side parts 4. Another embodiment is a rail 1 which a) is connected to or
b) is capable of being mounted with or
c) is formed integrally with the base 15 which is continuous or formed in sections.

In a rail/base embodiment, a natural good degree of convection can be achieved since air can pass over the heat exchanger 12 between the lining parts 10. If the mounting parts 2 and the rail 1 are mounted on a base 15, the lining parts 10 can be lower than the rail 1 on both sides or on one side and can also be formed down to the floor and can optionally have passages 15*a* in all parts of the lining 10.

These passages 15*a* may be slots, holes, spaces, etc. The lining 10 is held by mounting elements 24. The retaining mechanism for this purpose is shown in further Figures. The lower part 4*b* of the mounting part 2 is formed broader than the rail 1 since it is important when mounting the base that air is passed over the heat exchanger 12 from below on one or both sides.

In addition to the heat exchanger, cross-flow fans (heat accumulators, supply lines, discharge lines, etc.) can be held by the mounting part 2. It is therefore important that the width of the lower part 4*b* is preferably at least 50% greater than the width of the rail 1.

The advantage of a continuous rail 1 is virtually 100% longitudinal alignment of the entire system. The mounting parts 2 can be positioned according to the requirement of the heat exchanger 12 and of the lining 10 or support panel 16. However, it is fairly complicated to mount short sections of the rail 1 at intervals, which however would at least have the advantage of displaceability of the mounting parts 2.

The base 15 can also be mounted at intervals transversely to the heating system, and the distance between two bases 15 under the mounting parts 2 is preferably determined as the mounting place for cross-flow fan and/or accessories.

The width of the rail 1 compared with the mounting part 2 can account for, for example, 10% of the width of the mounting part 2 when, because of a broader heat exchanger 12 or other systems, the mounting part 2 is so broad or deep. Furthermore, the rail 1 may have greater height than width.

The bases 15 under the rail 1, arranged at intervals, can a) be mounted in correspondence underneath the mounting parts 2
b) be mounted to the side of or between the mounting parts 2.

It may be desirable for the base 15 to be continuous or optionally to be regulatable with the heating system and to have no passages 15*a*. Thus, half the air sucked in from below (natural convection) is sucked in from the rear side/wall, for example of a large window surface, and the other half of the air from the room side.

In another variant, the rail 1 can also be mounted a desired distance from the floor, on brackets projecting from a wall.

a) At least two mounting parts 2 are provided on at least one rail for holding a heat exchanger 12 or other systems and a lining 10 on both sides,
b) in the case of an interrupted rail 1, at least one mounting part 2 is present on at least one rail 1. The guiding of the mounting parts 2 on the rail 1 permits exact adjustment of the mounting parts 2 according to the requirements a) for supporting the heat exchanger 12 or other systems and
b) for mounting the lining 10 (in the case of butt joints) or support panel 16 and lining or only support panel 16.

Figure 8:
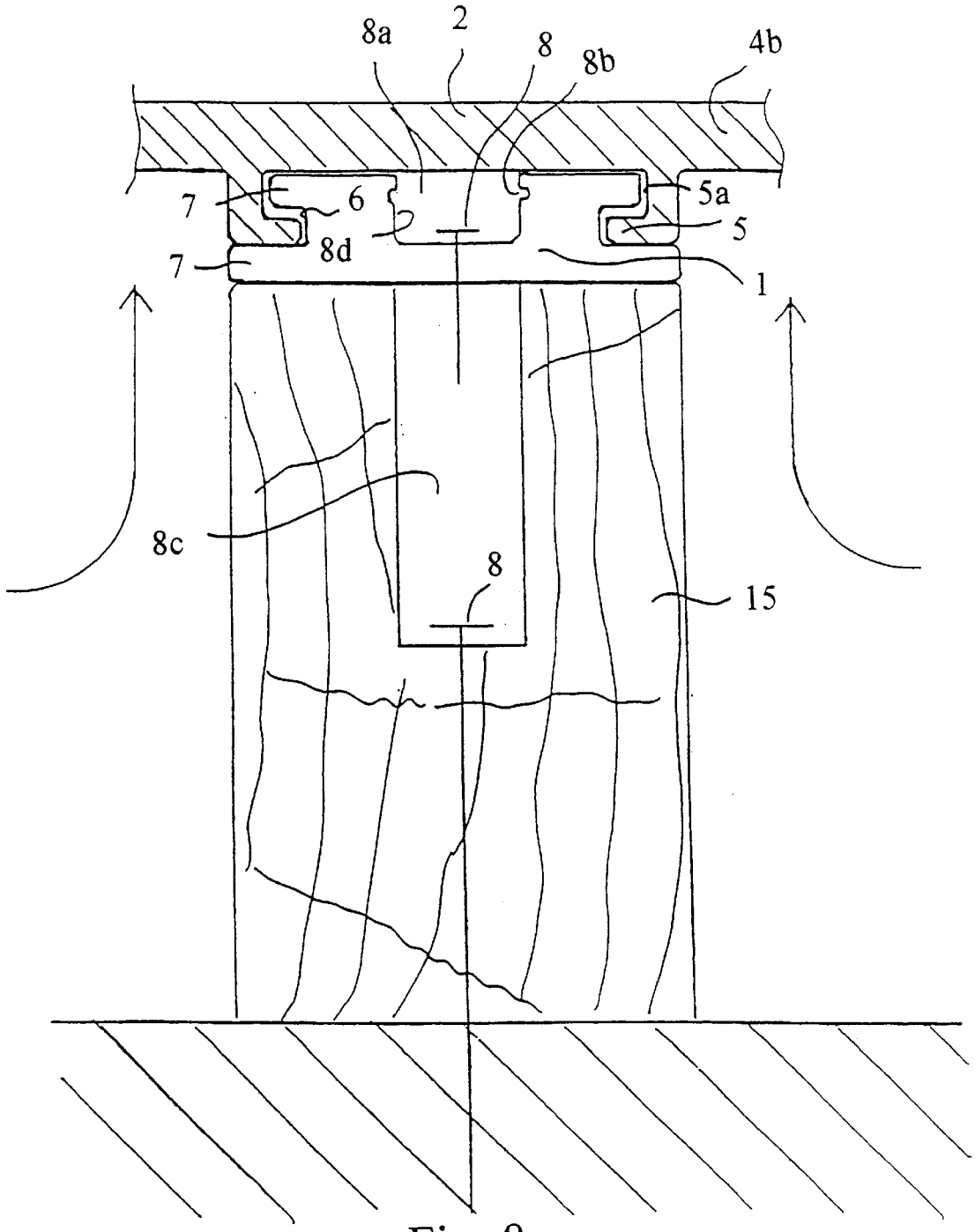
FIG. 8 shows a lower section of a mounting part or lower part, which is guided on a rail.

In a particular embodiment, the total lower convection orifice between front and rear, optionally lateral support panel 16 or lining 10 is divided into a front and rear convection orifice, and the rail is mounted on a) a continuous base 15
b) base 15 arranged at intervals
c) brackets projecting from the wall. (FIGS. 4, 8, 1A)

In a particular embodiment, the side parts 4 can be mounted on or pushed onto the lower part 4*b* of the mounting part 2 so that they cannot move, and movable mounting devices for support panels or lining 10 are formed on the upper end of rigid side parts 4 on both sides (FIG. 4).

FIG. 5 shows an embodiment according to FIG. 3. Instead of, for example, a wood lining as in FIG. 3, a lining 10 of, for example, marble/stone/ceramic, etc. is shown here. Such lining parts are of course also shorter than wood linings, for example 10–30 cm long, because of the danger of breakage. For this reason, too, such lining parts 10 are mounted on support panels 16 which may also have the advantage of transferring heat from the heat exchanger 12 to the lining, which can also be regulated by heat-absorbing or heat-shielding treatment of the support panel 16.

Here, the rail 1/mounting part 2 connection has another embodiment. According to the invention, many shapes are suitable for this rail-like system. Claw-like extensions 5 pointing inward or outward on the lower part 4*b,* extensions 7 or grooves 6 on the rail 1. The left side part 4 has a hook 21*a* in the extension part 9 and a pushed-on or mounted clamping device 17/17*a* with a hook 18 on the upper part. The upper hook 18 engages the hook 21 of the support panel 16 in a claw-like manner and the lower hook 21*a* engages the hook 21 of the support panel 16 in said manner.

Tiles, ceramic tiles, marble slabs, etc. having continuous or sectional grooves 19 at the top and bottom are then mounted on said support panels 16 in lengths of, for example, 100–200 cm, on hooks 18*a* of the support panel 16 at the bottom: they are held at the top by upper, preferably laterally movable clamping devices 17 and hook part 17*a* and hook 18 at the top.

On the right side: the support panel 16 is formed to be lower and hooks onto a claw 4*a* on the side part 4 and is held at the top by clamping device 17 and hook 18 (not shown). The lower part of the support panel 16 has a hook 18*a* which may have different shapes. A lower lining 10*a* is hooked into this hook 18*a* and held at the top by a clamping device 17 and hook 18 (not shown). A passage 15*a* (space) forms between upper lining 10*a* or support panel 16 and floor, as also shown in FIG. 3.

The embodiment according to FIGS. 3 and 5 is preferably intended for floor mounting, along a wall (window, etc.) from which cold downward flowing air is taken up through the passage.

In a particular embodiment, the extension part 9 is lower than the support surface for the heat exchanger 12 and a) has a hook 21*a* for a hook 20 of a support panel 16 b) has a support surface for mounting element 24 (FIGS. 5, 6).

Figures 6A, 6B:
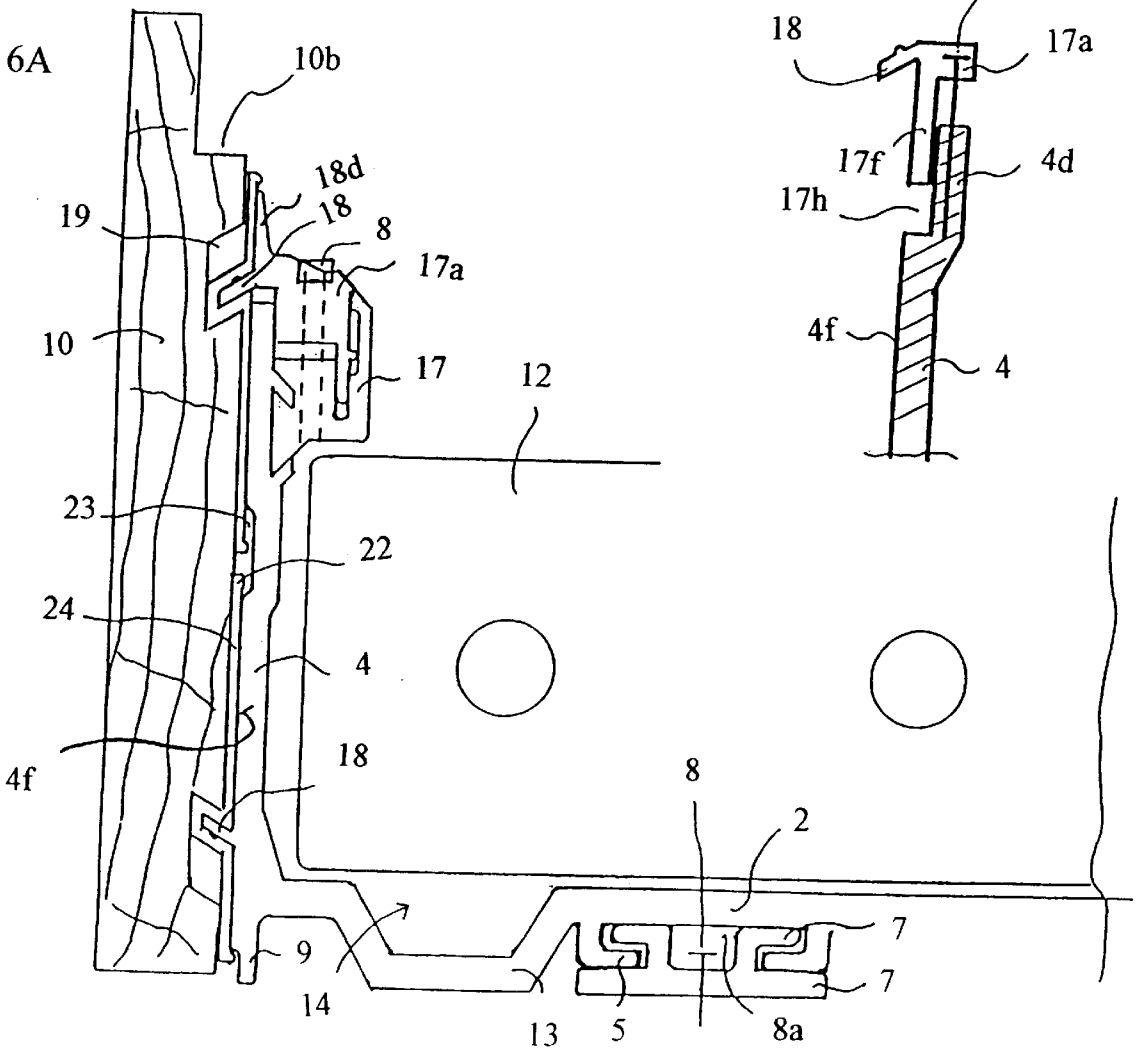
FIGS. 6A–6B show an embodiment according to FIG. 1.

FIG. 6A and 6B show an embodiment according to FIG. 1 (only the left side is shown). Here, a possible retaining mechanism for the lining for the lining 10 is shown. A mounting element 24 of metal or plastic is pushed onto a lower hook 18 which is formed from the lower part of the side part 4 (see FIG. 4). Also on the upper hook 18 of the clamping device 17, 17*a* which can be arranged on the upper part of the side part 4, in this case horizontally movable, but also immobile, as shown in the right embodiment. The mounting elements 24 are broader than the mounting part 2 (see FIG. 4). The side part 4 may have a space 23 in which thick parts 22 of the mounting element 24 can be accomodated. Hooks 18 and mounting element 24 hold the lining 10 through the grooves 19 which are present, in continuous form or at intervals, in the upper and the lower region of the lining 10. The side part 4 has a continuous surface, in this case interrupted only by the space 23, and presses together the mounting elements and the lining 10 by means of the hooks 18. There is thus a clamped connection of mounting element 24 (by hooks 18) with the lining 10 by virtue of the side part 4 resting extensively against the mounting element 24. A continuous surface of the mounting part 4 between lower, fixed hook 18 and movably arranged hook 18 at the top and mounting elements 24 arranged between lining 10 give effective surface clamping.

Instead of hook embodiment 4*a,* 18, 18*a,* 21, 20 for lining 10/19*a* or support panel 16, the side part 4 may also have, at its lower or upper end, grooves or extensions for snapping in a lining 10/10*a* or a support panel 16 and lining 10 or only a support panel 16. The lining 10 has, at the upper end, a support surface 10*b* for a grille 11, etc. (grille not shown). A clamping device 17 according to FIG. 6B is shown on the right. The side part 4 has a hook part 4*d* offset inward. An upper hook part 17*a* with a parallel guide part 17*f* fits into the resulting recess 17*h*. Together with the mounting element 24 (not shown), this results in exact guidance of the upper hook part 17*a* with hook part 4*d*. The hook part 17*a* and the upper hook part 4*d* are connected and adjustable by means of a screw connection 8. Preferably, the two parts are connected by a parallel pin connection, etc. (movable). On the right: a fixing part is preferably mounted between screw head 8 and one or two pressure springs, also, for example, flat springs or wire strap springs which presses [sic] the upper mounting part 17*a* downward, also, for example, a washer or parts which has [sic] at least the diameter of the spring or springs and either is [sic] adapted to the contour of the springs or, in the case of only one spring, has [sic] an inner or outer collar and thus prevents [sic] the springs from slipping. The screw 8 ends in a blind hole in the hook part 4*d* offset inward, and the hook part 17*a* is thus spring-mounted upward and downward. The upper hook part 17*a* may have at least one groove or one extension which are guided longitudinally or transversely and in diametrically opposite forms in the mounting part 4*d* offset inward. Column guides too are possible by means of at least one parallel pin.

In another embodiment, the mounting elements 24 are not used and the side parts or the hooks 18 have the necessary width. 18*d* is a support extension for a lining 10 or a mounting element 24 plus lining or support panel 16. In a particular embodiment, the complete side parts 4 for holding the lining 10 by means of mounting elements 24 consists [sic] of the following parts:

a) rigid part of the side part 4 b) preferably inward-offset hooks 4*d* c) upper hook part 17*a* d) fixing part which are held together and guided by a) a screw 8, held by the fixing part b) at least one lateral guide or by webs and grooves and the previously mentioned parts. The lateral guide is preferably mounted on both sides of the screw and fixed by the lateral guide or formed as an integral part.

a) in the inward-offset hook part 4*d* b) in the upper hook part 17*g* c) in the fixing part.

In a particular embodiment, a continuous or briefly interrupted surface of the side part 4 between lower hook 18 and upper hook 18 press [sic] an upper and a lower mounting element 24 between support surface 4*f* and lining 10 (FIG. 6).

In a further particular embodiment, the upper hook part 4*d* is offset inward and a guide part 17 fills the recess 17*h* and the guide part 17*f* forms a straight surface with the support surface 4*f* of the side part 4 (FIG. 6 right).

In a particular embodiment, two side parts 4 of a mounting part 2 are pressed one into the other by a hook device 18/18/21/18 and optionally also in combination with a support surface 4*f* having mounting elements 24 and lining 10 or a support panel 16 (FIGS. 6, 11, 11A).

In a particular embodiment, an upper hook part 17*a* has a guide part 17*f* which is supported or guided in a recess 17*h* of an inward-offset hook part 4*d* (FIG. 6). The upper part of the lining 10 and of the support panel 16 plus lining 10 and only the support panel 16 (FIG. 11*a*) and preferably also their side lining 10*n* and 16 (FIG. 14) may be formed to have a pronounced overhang in the inward direction above the groove 19 (lining 10) or above the hook 21 (FIG. 11*a*) and partly or completely cover the fastening system of the lining 10 and/or the support panel 16, it also being possible for this overhanging part to be formed as support surface 10*b* (FIGS. 11*a, b*) in various forms (FIGS. 6, 11*a,* 13).

Figure 7:
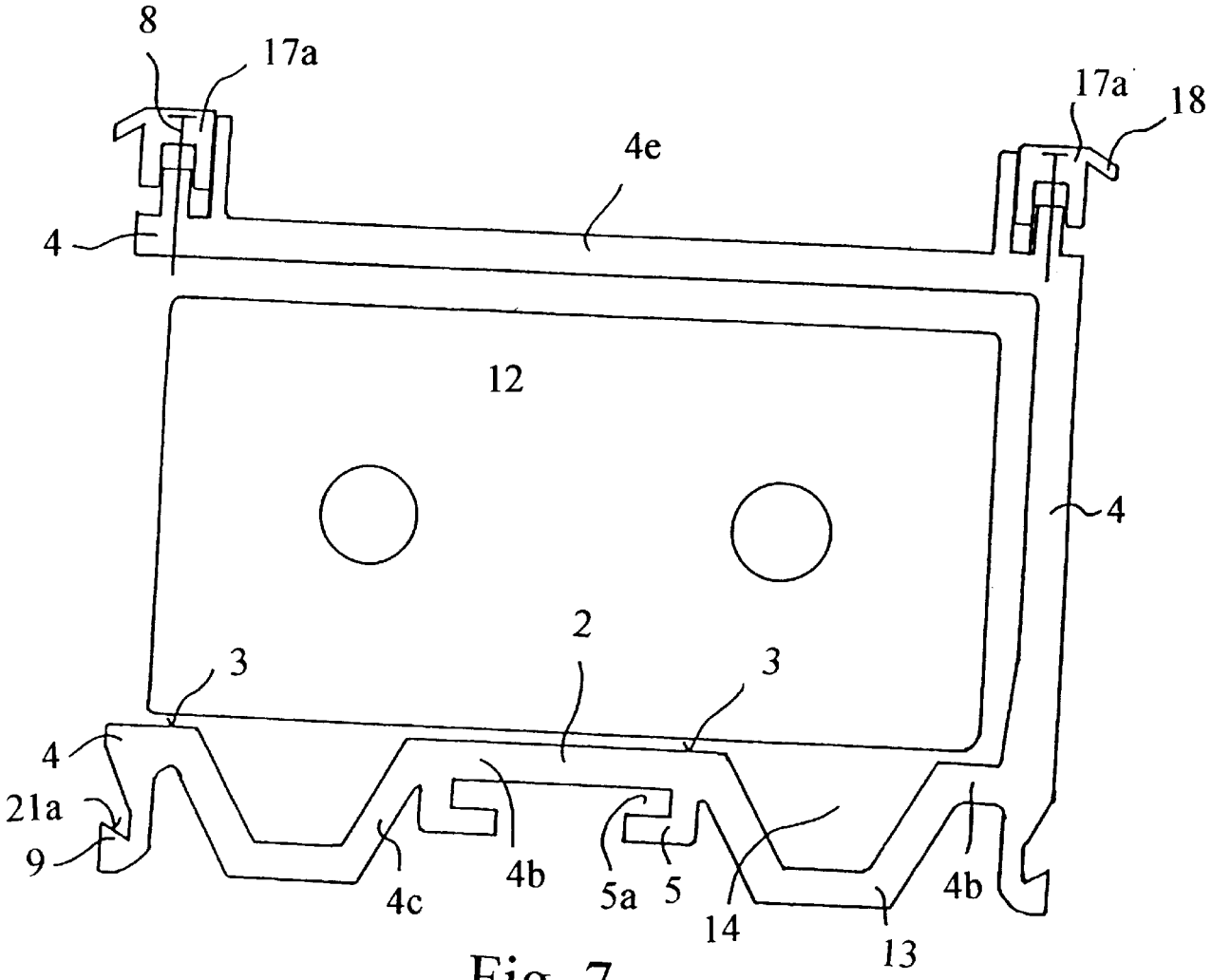
FIG. 7 shows a diagram of an embodiment according to FIGS. 5 and 6.

FIG. 7 shows a diagram of an embodiment according to FIGS. 5 and 6. The rail 1 and lining 10 or a support panel 16 are not shown. Following FIGS. 5 and 6, where the mounting part 2 is open at the top, in this Figure the mounting part is open to the left side and has an upper and a lower side part 4 to the left. The right side part 4 is continuously/integrally formed. The left, interrupted side parts 4 have the same function. Optionally, the left side parts 4 can be connected to a rigid connecting part after the insertion of the heat exchanger 12. In this embodiment, the heat exchanger 12 (different designs) can be introduced from the left side, and it is also possible to connect this heat exchanger 12 directly to a support panel. The mounting part 2 consists of a lower part 4*b* which has, on the lower surface, two extensions 5 for a rail 1 (not shown) and a support surface 3 or convection orifices 14 and a lower support surface 13. The upper hook parts 17*a* with hooks 18, mounted at the top, are connected by an upper part 4*e*. The support surface 3 is interrupted by convection orifice 14. The support surface 3 becomes a bounding surface in which a heat exchanger 12 is held a small distance away if the heat exchanger 12 is connected to a support panel 16 so that heat exchanger 12 does not rest on the total mounting part 2 and need be held only by the support panel 16. The lower part 4*b* in the region of the rail 1, which is not shown, has oblique (or perpendicular) side parts 4*c* on the left and right. Extensions 5 or grooves 5*a* may also be formed on these side parts 4*c*. In addition, these side parts 4*c* may also serve as bounding surfaces and supports for the rail 1. This representation can also be realized for an embodiment having mounting elements 24.

In a particular embodiment, at least one side part 4 has a rigid connecting part which is held by a lower part 4*b* and an upper part 4*e* and can be pushed in or on, snapped in or mounted on, and optionally a side part 4 for wall mounting is formed; FIG. 8 shows a lower section of a mounting part 2 or lower part 4*b* which is guided on a rail 1 (diagram on a slightly larger scale). Two extensions 5 in the form of inward-pointing claws are formed on the lower part 4*b* and engage a left and right groove 6 in a rail 1. The groove 6 is formed by two extensions 7 of the rail 1 and engage [sic] grooves 5*a* which are formed by the extensions 5. The grooves 6/5*a* and extensions 5/7 may have different shapes. Thus, it is also possible for only one extension 5/7 to be guided in a groove 6/5*a* (T-shaped, dovetail, etc.). The extensions 5/7 can also be outward-pointing and the extensions 7/5 inward-pointing, etc.

Thus, it is also possible, for example, for the lower extension 7 to have an upward extension and thus enclose the lateral surface of the extension 5. The lower part 4*b* may also have side parts 4*c* and enclose the rail 1 in the manner of a hood, with the extension (see FIGS. 9 and 10). A preferably continuous channel 8*a* is present in the middle of the rail 1, which channel has space for a screw 8 or the like. By means of this screw, the rail 1 is fixed to the floor or to a base 15 or to a bracket at intervals. The screw 8 is protected in the channel 8*a* and, neither in width nor in height, hinders the uniform behavior of the mounting part 2, and there is therefore no need to countersink the screw 8 in the rail 1, which would of course also be possible. The screw channel 8*a* may also be formed in the lower part 4*b* of the mounting part 2. The mounting part or rail 1 or both or parts thereof may be produced from a resilient material, and the two parts can be joined by snapping.

The base wood, plastic, metal, etc. has a hole 8*c* in the region of the screw channel 8*a* or to the side of it and is fixed to the floor by means of screws 8. It is also possible by means of a screw (setscrew for example) which is mounted in a threaded hole in the lower part 4*b* and is screwed so far into the channel 8*a* and in the floor, supported by the screw channel 8*a,* presses the mounting part upward, and fixation of both parts is achieved. A lateral notch 8*b* can support such fixing. The air is introduced on both sides of the base 15 or of the rail 1 (arrows). The side walls 8*d* may be formed to be oblique, which has advantages when connecting two strips 1.

In a particular embodiment, the screw channel 8*a* has a notch 8*b* on one side or both sides.

Figure 9:
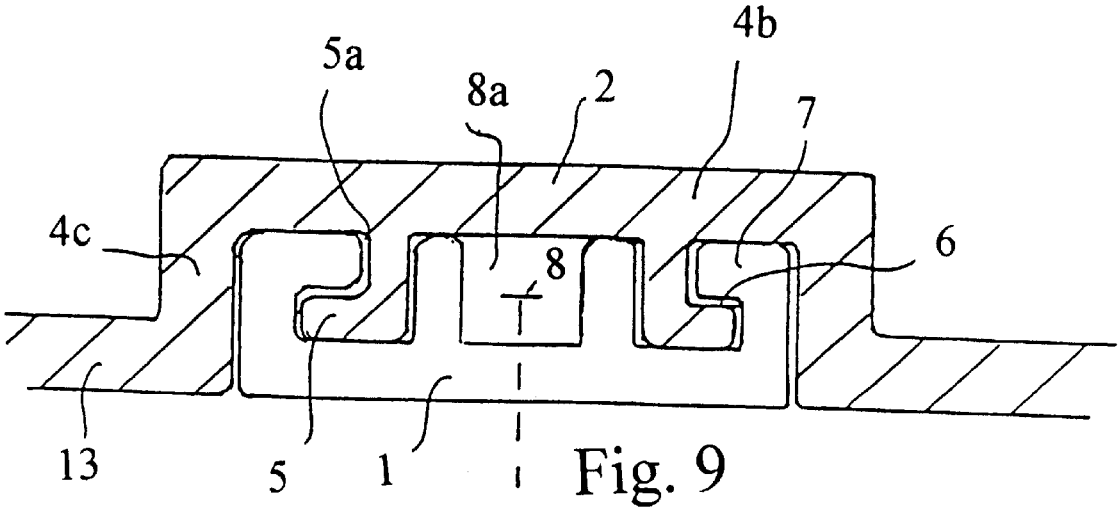
FIGS. 9 and 10 show a mounting part or lower part guided on a continous rail.
Figure 10:
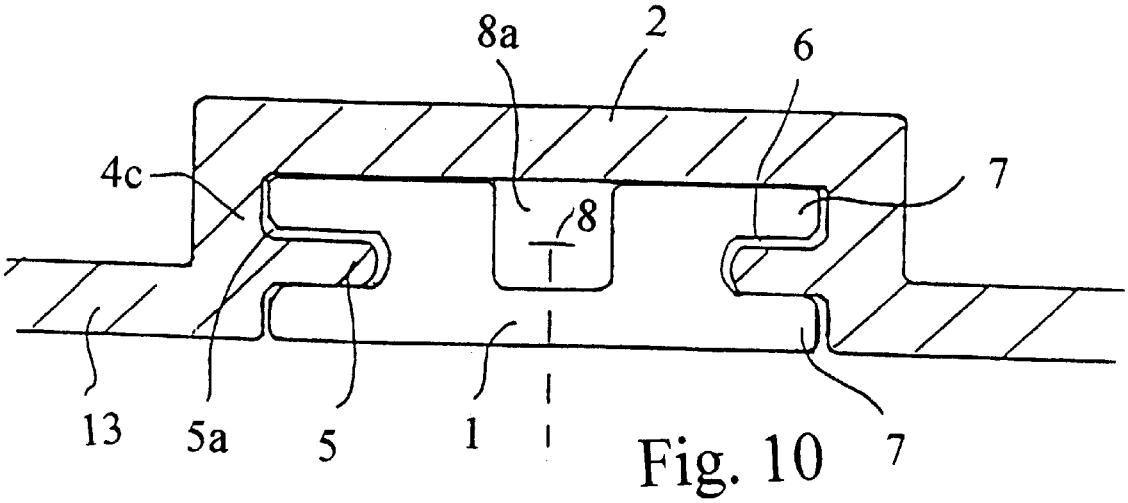

FIGS. 9 and 10 show a mounting part 2 or lower part 4*b* (shaded), guided on a preferably continuous rail 1. The bounding parts 4*c* are perpendicular and additionally anchor and hold the mounting part 2 on both sides in or on the rail 1. The bounding parts 4*c* may also be obliquely formed. As a result of the perpendicular or oblique bounding parts 4*c,* the rail 1 is held in addition to the connections comprising extensions and grooves. For reasons of ventilation, rail 1 may slope upward and inward on both sides (FIG. 1) and it is possible to form these oblique surfaces without roughness (no grooves, extensions, channels, etc.), and to achieve guidance by extensions or grooves in the inner part of the rail 1. Passages may likewise be made in the region of the channel 8*a,* for reasons of ventilation. These representations are also intended to show that various tooth connections of the mounting part 2 and rail 1 are possible.

In FIG. 9, the extension 5 is formed from the lower part 4*b*. In FIG. 10, the extension 5 is formed from the bounding part 4*c*. The extensions 5 and 7 may be formed on the inside or outside—likewise the rail 1 with groove 6 or the mounting parts 2 and groove 5*a*. Guides of only one extension in only one groove are also possible—regardless of in which part the groove or the extension is located. In another embodiment, for example in upright embodiments, the lower part 4*b* and the side parts 4 have the following features: the lower part 4*b* has, on both sides or on one side of the rail 1, a frame embodiment with preferably hollow profiles which can be formed more weakly in relation to the side parts 4, for example short support surfaces with the features 25*b* and 25*a* from the side parts 4 (25*a* also in the upper side part 4). An air gap remains open in lower part 4*b* so that there is space for good air circulation also in the region of the lamellae of the heat exchanger. In the case of such a frame embodiment and a relatively narrow, high embodiment of the heat exchanger 12 or a desired height of the convection channel, a rail 1 is provided which is formed narrower and higher than the embodiment already described, so that the necessary air can also circulate on one side or on both sides. The frame embodiment provides more stability. In yet another embodiment, the rail 1 may be formed to extend lower compared with the support part 13 and/or the extension part 9 and/or the lower part of the lining 10.

In a particular embodiment, the rail 1 is guided linearly or obliquely between two side parts 4*c* and optionally a projection 7 and 5 engage one another, the projections 5 being formed from the side parts 4*c* or the lower parts 4*b* (FIGS. 1A, 10, 9).

FIG. 11A shows on the right a left half of a mounting part 2 with an inserted heat exchanger 12. A left, continuous support panel 16 and a mounted lining 10 held by hooks 18*a* a distance apart is shown on the left. On the right: the side part 4 formed from the mounting part 2 or lower part 4*b* has an upper, inward-offset hook part 4*d* and a lower, inward-offset hook part 4*d*. The outer (left) side part 4 has a support surface 4*f* which, in the mounted state, rests on the support panel 16. The side part 4 fits the contours of the support panel 16 and thus increases the stability of the total construction.

Figure 11B:
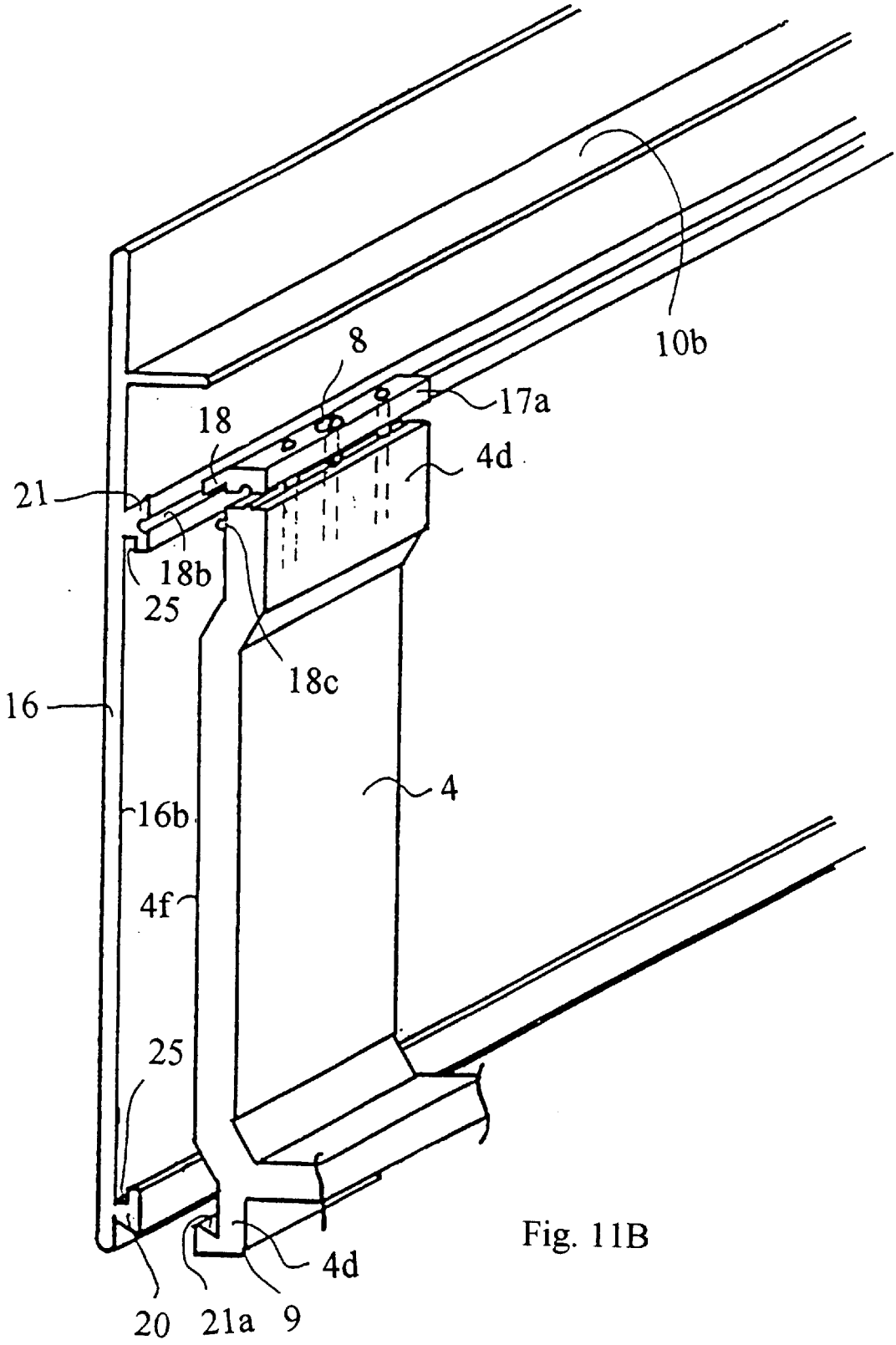
FIG. 11B shows the subject of FIG. 11A in the unmounted state.

A hook embodiment 18 of an upper hook part 17*a* is preferable spring-mounted by means of a screw 8 and, for example, mounted on the inward-offset hook part 4*d* by means of a guide pin. By means of the upper, movable hook 18 and the lower, rigid hook 21*a*, the continous support panel 16 is held at intervals by the side parts 4. The hook 21*a* is simultaneously also an extension part 9. An upper groove 45*a* is formed from the upper hook part 4*d*. Likewise, a lower groove 25*a* is formed from the lower part 4*b*, preferably opposite. These grooves are to be used for pushing in fastening parts 114 or accessories for heat exchangers or heating or cooling accessories air guide plate 117, etc. or snapping on one side or both sides (also in an embodiment according to FIG. 6, etc.). For lateral bounding of a heat exchanger 12, an oblique extension 25*b* is formed from the lower part 4*b*. Upper grooves 25*a* or extensions, etc. can be formed in cooperation with rigid connecting parts which connect the side parts and strengthen the construction. On the left: a support panel 16 of plastic or metal (may also be formed as lining 10, as shown in FIG. 11B) could also have mounted or formed heat exchangers 12 on its inside. A height-adjustable upper hook part 17*a* and hook 18 for fastening the lining 10 is not shown-see FIGS. 19 and 20 and 5.

The clamping device 17 can preferably be pushed or snapped onto the support panel 16 and arranged so that it is horizontally movable. A clamping device 17 for tile or ceramic tile, etc. is sufficient and is also preferable. The length of this clamping device 17 could be, for example, 20–40 mm. The support panel 16 has an upper and a lower groove 25 which are preferably formed opposite one another and between the hooks 20 and 21.

The support part 16*b* may be formed smooth or may have, for example, longitudinal channels. These longitudinal channels would save material and increase the surface area of the support panel 16, which would be advantageous for absorbing heat radiation. The hooks 20 and 21 and grooves 25 underneath them in the support panel 16 fit in the contours of the side part 4 or hook parts 4*d*. The support panel 16 has a continuous recess 16*a* in the upper part so that a continuous gap is formed between lining 10 and support panel 16 and is intended for a support device for a ventilation grille (see FIG. 12). Between the grooves 25, it is advantageous to have a) a support surface 16*b* for the support surface 4*f* of the mounting part 2,
b) a support surface 16*b* for absorbing heat radiation,
c) from groove 25 to groove 25, a surface for pushing in connecting parts for support panel 16 one under the other and mounting aids but also for lateral lining (Fig) which may also be formed from support panels, etc. (also see FIG. 13).

Support panel 16 with grooves 25 for pushing in, fixing, etc. of connection parts 26 (FIG. 13), optionally also with a recess 16*a* for the insertion of brackets 27 and/or support parts 28, can also be used for mounting parts for wall mounting with only one front lining and optionally lateral lining.

A support panel 16 and a lining 10 or only a support panel 16 according to FIG. 11*a* may be used for two-sided (front and rear and lateral) and also only for front linings of heating systems.

Instead of hooks 21/20, other fastening parts for diametrically opposite fastening parts of the side part 4 can also be mounted. In another embodiment, it is desired that a mounting can also be applied through the side part 4 in the region of a connecting part 26, pushed into the grooves 25. The support surface 4*f* is then reduced in size at least to such an extent that the connecting part 26 has space between the support surface 4*f* and inner part 16*b*.

At least the upper hook 21 (as in the case of hook 18) of the support panel 16 can be formed to be movable (as in the case of 18/17 or 17/17*a*/18/17/18 from FIG. 5) and can hook or snap into the upper part of the side part 4.

The support panel 16 for the lining 10 may a) be formed rigidly and compactly and without spring-mounting
b) be formed to be capable of being snapped on under spring load or have such parts.

Heat exchangers 12 of various types may also be applied or mounted or integrally formed on the inside 16*b*. Constructions having such support panels can, according to the invention, also use vessels, containers, coverings, etc. of various types.

The grooves 25 are preferably present under or between the hooks 20 and 21. The grooves 25 as well as the grooves 25*a* are also intended for holding mounting devices for heat or cold shields, which can be mounted on one side or both sides of the heat exchanger 12.

Other systems for cooling or heating may also be held there. In a particular embodiment, at least one groove or an extension/hook, etc. is provided in the upper part of the sides parts 4, preferably in or below the inward-offset hook part 4*d*, and a rigid connecting part with grooves or extensions/hooks, etc. on both sides, in cooperation with diametrically offset grooves or extensions, connect the two side parts 4;

In another particular embodiment, two grooves 25*a* for mounting purposes are formed opposite one another on the inside of the side part 4, which grooves have, in the lower part, a boundary of a rigid extension 25*b*, preferably formed obliquely. In a further particular embodiment, the upper part of the support panel 16 has a continuous recess 16*a* for insertion of a bracket 27 for holding a ventilation grille 11 (FIGS. 11, 12, 19, 20, 5).

In another particular embodiment, the support surface 16*b* of the support panel 16 has a surface area-increasing surface (longitudinal or transverse channels, points, waves or nubs or the like) (FIG. 11). In a particular embodiment, the side parts 4 have an upper, optionally also lower, inward-offset hook part 4*d*, and a support surface 4*f* for a support panel 16 or mounting elements 24 or only a lining 10 is provided in between (FIGS. 11A, 11B, 6 right). In a further particular embodiment, between upper and lower hook 21, 20 of a support panel 16 is preferably formed for pushing into a diametrically opposite groove 25, preferably with a) linear connecting parts 26 or angled connecting parts 26
b) nonlinear connecting parts 26 in combination with nonlinear support surfaces 16*b* (FIGS. 11A, 11B, 14, 13A–13B).

FIG. 11B shows, in the unmounted state, in approximately natural size, the subject of FIGS. 11A and 11B, that a support panel 16 and a side part 4 are a distance apart. Here, a support panel 16 without lining 10 is shown. Such a lining is also not intended in this embodiment. An external design is not shown. As a result of the upper pressure-compensating connection comprising extension 18*c* and groove 18*b* and as a result of the inward-offset hook part 4*d* in which there is space for the hooks 20 under 21 over the support panel 16 and as a result of the support surface 4*f* of the side part 4 on the support surface 16*b* of the support panel 16, there is a very secure, compact, undistortable mounting. A screw 8 presses the upper hook part 17*a* with hook 18, a left and a right guide pin (shaded) constitutes the guide of the upper hook part 17*a*. A continuous projecting support surface 10*b* for a grille 11 or the like is formed from the support panel 16. An upper and a lower groove 25 and a straight support surface 16*b* located in between is formed for pushing in preferably linear connecting parts 26. Support panels of the type shown here can be used for heating systems with only a) front and lateral lining, b) front and rear lining with side linings, c) for vessels, containers and lining of all types. At least one groove/extension connection or other diametrically opposite markings for fixing during processing (holes) are present, preferably continuously, between upper hook part 17*a* and inward-offset hook part 4*b*.

In a further particular embodiment, the upper and the lower, inward-offset hook part 4*d* is offset inward to create space for a lower hook 20 and an upper hook 21 of a support panel 16 (FIGS. 11A, 11B). In a particular embodiment, a support panel 16 has an upper support surface 10*b* for a ventilation grille (FIG. 11B).

FIG. 12 shows a diagram of the upper part of a support panel 16 with a lining 10 according to FIGS. 11A and 11B. A recess 16*a* in the support panel 16 forms a gap between lining 10 and support panel 16. Brackets 27 are guided or held in this gap on the support panel 16 mounted on both sides or on one side. A left and right bracket are connected to a support part 28 or formed integrally with said part. The support part 28 can be produced, for example, from plastic and have grooves for inserting the upper part of the bracket 27 and can thus be adjustable. The support part 28 with the bracket 27 is displaceable in the groove 16*a,* as indicated by the arrows. A support 28 is intended for a grille 11, except that in this case it rests on the support surface 28 instead of on the lining 10, as shown in FIG. 1. The brackets 27 and the support part 28 may be formed from the same material and may also be produced in one piece. Such a bracket 27 and support surface 28 may also be formed only on one side if the support panel 16 is mounted only on the front of a heating system. The bracket 27 or support part 28 (formed to be dismantlable or as a whole) can be used everywhere in the system and is also displaceable. The recess 16*a* is therefore formed to be continuous.

FIG. 13 shows two parallel support panels 16 which are completed by a support panel 16 intended for lateral termination. Connecting parts 26 (in this case brackets) are pushed into the grooves 25 in the lateral support panels 16 and are adjustable until possible fixing. This lateral support panel 16 or other side parts having pushed-in connecting parts 26 are connected to the two parallel support panels by inserting into the grooves 25 (see arrow). This connection can be moved for adjusting the lining 10 (not shown). If the exact position of the lining parts is established, the parts can be adhesively bonded to one another or screwed together by setscrews or screws. Preferably, such connections should be readily detachable, which is the case for screw connections.

By using conventional brackets of metal or plastic or bent metal sheets, etc., various angles can be produced. Since the connecting parts 26 are used only for terminations and support panel connections, they do not interfere with any other functions of the side parts 4 and of the support panel 16. Such connections of support panels 16 with lateral support panels 16 by means of brackets even only on one side or connections of support panels can be used for all those already used or described, also only for front support panels 16 or lining 10 and also the mounting parts for heat exchangers, which parts are described here.

The connecting part 26 may have various angles but may also be flat (see Figure on right) and may be produced from various materials. On the right: View from the front, two support panels 16 mounted side by side are connected by a connecting part 26—the position of the connecting part 26 behind the support panel 16 is shown as a dashed line. In this diagram, the connecting part is clamped by setscrews. Drilling and screwing is also possible, and it is also sufficient to use only one screw on each side. The grooves 25 will also be used for inserting/snapping in, etc. mounting surfaces or mounted parts, such as, for example, electrical accessories, heat exchangers, etc.

The grooves 25 at the top and bottom may also be closed, and the connecting parts 26 may be adapted by being pin-like, etc. On locking together at least two support panels 16 with or without heat exchanger 12 mounted thereon or formed therein, a connecting part 26 is fixed, in particular detachably (example: bolt, screw, adhesive bonds), between two support panels 16, in order that the lining 10 can be moved as a result of heat expansions of the support panels 16 and thereafter.

Support panels 16, locked together with connecting parts 26 in a straight or angled embodiment for front or side lining, can also be used for heating systems having only one front and optionally side lining (and mounting parts suitable therefor). Support panels 16, combined with connecting parts 26, are also used in support panel 16 from FIG. 11B —but for visual reasons preferably butt-jointed or, in the case of an angled embodiment, cut with a bevel. Fastening may be effected by exact fitting in and adhesive bonding. To form exactly formed side support panels 16 (shown on the left) or their lining 10 (not shown), the front and rear support panels 16 (shown in the middle) or linings 10 are laid and held exactly parallel. By means of mounting parts 2—guided on a rail 1 by connecting parts 26 connected to the side support panels 16. This embodiment is an exact frame construction of the flat lining parts 10. A stable, exact construction of a heating/cooling system or of a convection shaft or of a container generally, also in very long lengths with front, rear and optionally also lateral support panels 16 and lining 10, is achieved by the interaction of all essentially loose parts. In another particular embodiment, the frame construction viewed from above or below consists of at least one front and rear support panel 16 and optionally also lateral support panels 16 with or without lining 10, the front and rear support panel 16 and the lateral support panels 16 or side parts being connected by means of connecting parts 26 in grooves 25 by the plug-in method, and the front and rear support panels 16 are held exactly parallel by a mounting part 2 or side parts 4, and the mounting part 2 is guided on a rail 1 which is mounted on the floor, wall, etc., on a base 15 or brackets, and, instead of the support panel 16, the frame-like construction consists of the lining 10 and optionally side linings 10*n,* which is butt-jointed by means of side parts 4 and optionally by means of the mounting element 24 along the lining (FIGS. 4, 13A–13C, 2, 26, 27, 28).

Figures 13A, 13B, 13C, 13D:
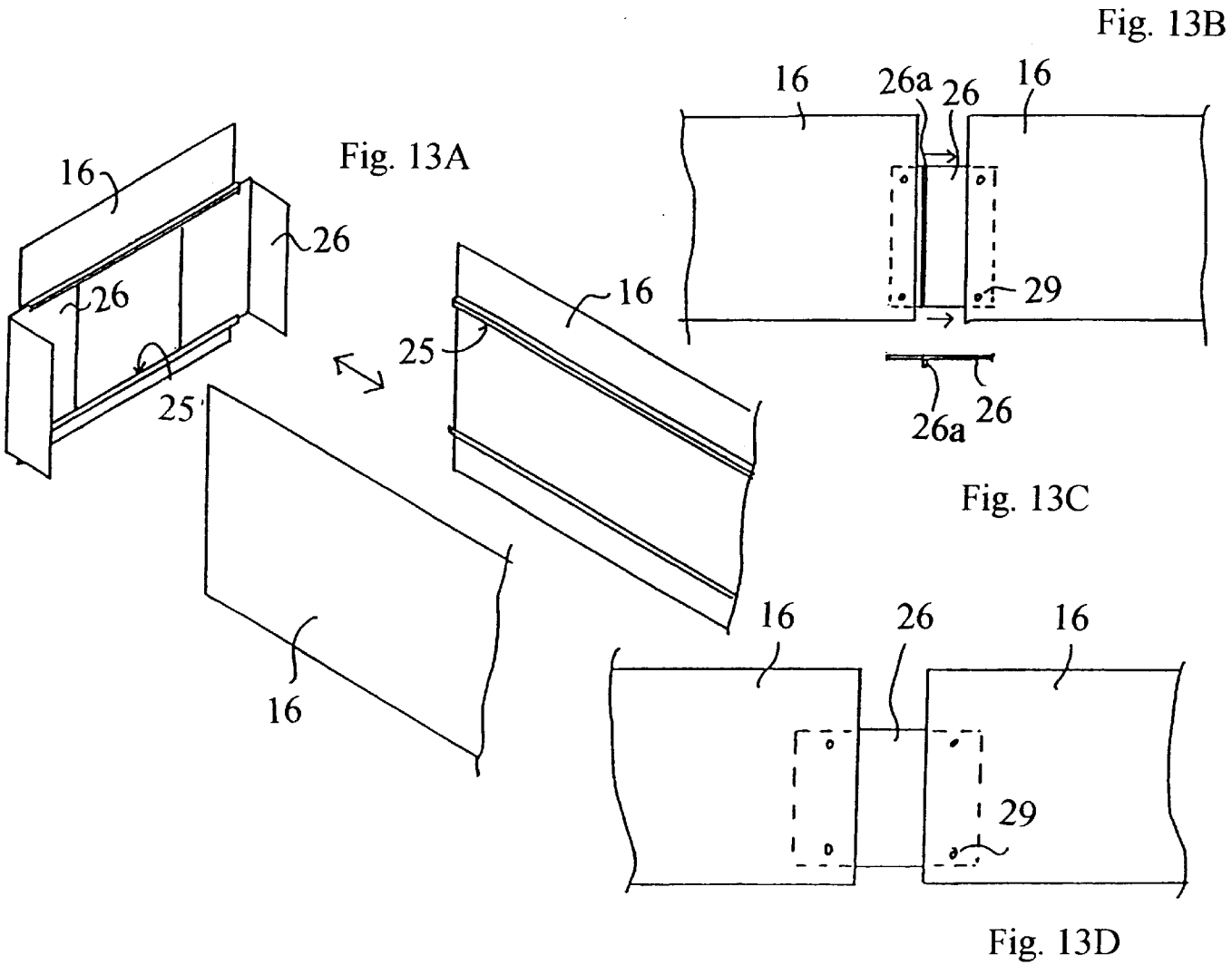
FIGS. 13A–13D show two support panels that are held or detachable fixed in an abutting manner by a connecting part.
Figure 14:
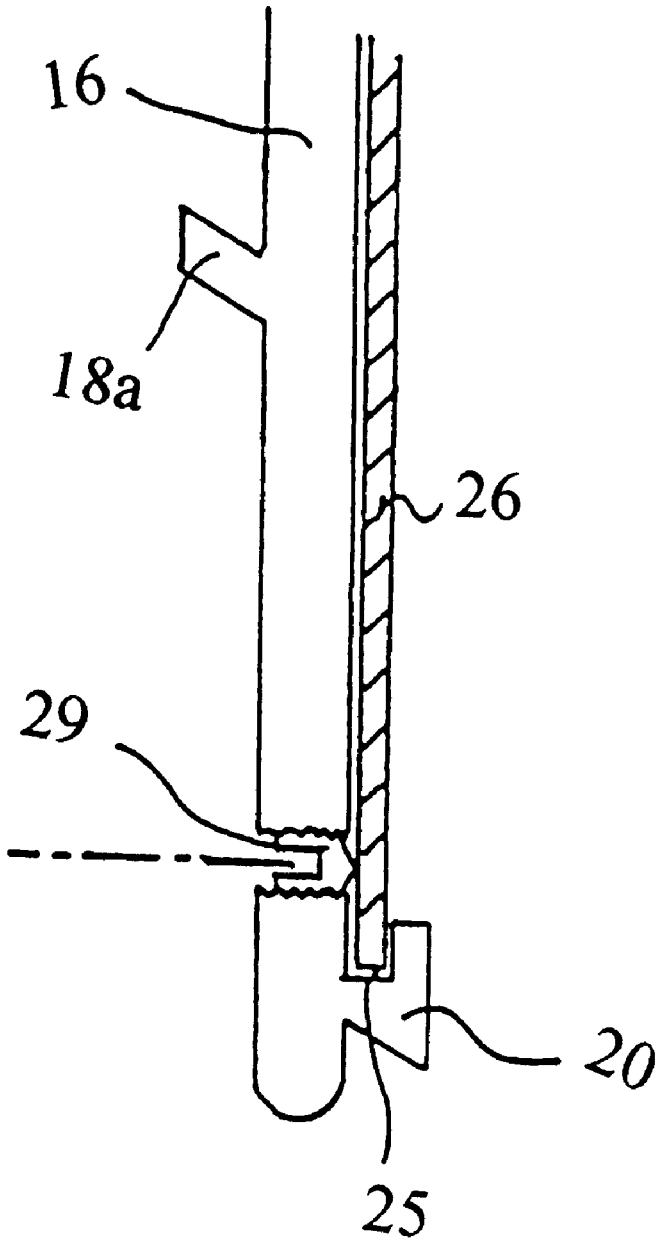
FIG. 14 shows the lower part of a support panel according to FIGS. 11A–11B and 13A–13D.

In a further particular embodiment, the support panel 16 can be connected to one another linearly or in any desired angle connecting parts 26 inserted into the grooves 25, without mounting parts 2 being required for this purpose, the connecting parts 26 being capable of being fixed by setscrews 29 or other screw devices or by adhesive bonding or clamping (FIGS. 13A, 14, 13B).

FIG. 13B shows two support panels 16 which are held or detachable fixed in an abutting manner by a connecting part 26. For example by setscrews 29 which may be pointed or flat and which either only clamp or can also be screwed partly or wholly through the connecting parts. Only one screw on each side is also sufficient. The connecting part 26 has a web 26*a* which is raised and whose height corresponds to the thickness of the support panel 16 or is less than this. The web 26*a* may be mounted in the middle or slightly to one side of the connecting part 26. Instead of the web 26*a,* point-like extensions or holes may also be provided. By means of this web 26*a* of connecting part 26, the latter can be displaced laterally by means of a finger or a pointed, flat tool, etc.

The web also serves as a support surface on the support panel; owing to the possibility of fixing the connecting part 26 on both sides to the support panels 16, exact constructions can be produced. The upper and lower arrow shows the direction in which the connecting part 26 is moved without changing the position of the support panel 16 or of the lining 10, and an individual support panel 16 can be easily removed from a system, for example for repairs, etc.; which may be the case especially with electrically operated heating systems. Such a possibility for repair is advantageous in particular in the case of heat exchangers 12 mounted on the support panel 16 in heating systems having only one front support panel. Such a construction of fixable connecting parts 26 with support panels 16 is necessary if the support panels 16 are not connected to one another and if further transport of the support panels 16 in relatively long systems takes place as a result of thermal expansions. In practice, the lining parts 10 (stone slabs, etc.) will behave in the same way as beads threaded on a rubber band if the rubber band is expanded, i.e. the distance between the tiles will slightly increase, and no stresses occur. For example, this will be necessary in practice if the support panels 16 are, for example, adhesively bonded or connected in a modular manner in each case to the inside of a heating system (also electrical), and each module (support panel 16) expands as a result of thermal expansion. It should also be used in the case of support panels which receive the heat through radiation from a heat exchanger 12. Such connecting parts 26, preferably also a web 26*a,* should be used in one-sided (only front) or two-sided (front/rear) applications of the support panels or side parts.

In a further particular embodiment, the connecting parts 26 have a web 26*a* or other protuberances (FIG. 13B).

FIG. 14 shows the lower part of a support panel 16—according to FIGS. 11 and 13A to 13D; a groove 25 is formed on the inner parts of the hook 20. A connecting part 26 is inserted at the bottom and top (not shown) and is fixed or clamped from the front by means of a setscrew 29. Screwing through the connecting part 26 is also possible. Clamping by a setscrew is preferably carried out in the region of the groove 25 since sagging of the inserted part 26 would occur in the middle region; the screw-through variant may also be provided in the middle region. The setscrew or the screw does not hinder the lining 10, as shown in the diagram.

FIG. 19, right, shows a cross-section of a continuous support panel 16 and of a two-part clamping part which is mounted at intervals. The support panel 16 and the two-part clamping part 17/17*a* may be made of various materials (plastic, metal, etc.). An upper hook part 17*a* adjustable to be higher and a linearly displaceable clamping device 17 for holding a lining 10 by means of a hook 18 on the upper part 17*a* [sic]. A thread for a screw 8 is formed on this clamping device 17/17*a* described here. The clamping device 17/17*a* which is, for example, about 30 mm wide is formed springing apart for one or two springs (spring not shown) and is adjustable relative to one another by means of a screw 8. Apart from the screw 8, the upper hook part 17*a* and the clamping device 17 are brought together by means of an extension 106—groove 105 connection which is formed to be continuous or is in the form of points (pins, wedges, corner connections, straight pin, etc.). FIG. 20 shows a converse embodiment.

The clamping device 17 has a support extension 103 which is guided in a groove 104 of the support panel 16. The groove 101 likewise provided in the clamping device 17 is guided by a diametrically opposite extension 100 of the support panel 16. Thus, the clamping device 17 forms a very broad, deep support surface 102 (for example a dovetail guide) with the support panel 16 or the support extension 103 is guided in the support panel 16. The converse is also possible by means of similar extensions or grooves. The essential feature is the broad high execution surface 103/102, preferably extending higher lower [sic] than the clamping device 17.

Mounted in the upper hook part 17*a* is a continuous or point-like extension or a step 109, which extension and which step are formed to be continuous or point-like in a recess 108 of the support extension or of the upper hook part 17*a* and forms a support surface or a point 110 for a step 109. The double clamping part can thus be adjusted relative to one another and cannot fall apart when moved apart; it thus locks 109/110 [sic]. The springs used cannot spring away (springs not shown).

A hook embodiment 18 which is formed from the upper hook part 17 has a preferably round support surface 111 and a space 112 to avoid resting flat on the flat support surface 113 of the cover 10, which might lead to splintering on only slight tilting of a parallel hook 18 in the case of brittle covers. This can be prevented by the round part 111 of the hook 18 and the space 112. The preferably round support surface 111 can also be produced from plastic or/coatings [sic], for example by immersion in corresponding plastics or surface coatings, etc. Furthermore, the hook 18 itself or the upper part 18 may consist of resilient material.

The hook 18 itself and any support surface or inserted surface may also be formed from spring plate. The clamping device 17 (without support extension 107) is lengthened at least by 10% by the support extension 103. A hook embodiment 18 holds the lining 10 under a support panel 16. The difference from previously known embodiments of two-part clamping parts (17*a*.17), in which the clamping device 17 is held linearly on the support panel 16 by means of, for example, a dovetail guide, is that at least one support extension 107 is formed in order to prevent the upper hook part 17*a* from easily tilting away. Since a further parallel guide 107/17*a* or 17 is present in addition to the parallel guiding of at least one extension 106 in at least one groove 105, at least one straight pin may, if required, also be used as a guide. A type of locking which is not shown comprises providing a recess or a support point inside the upper part 16 of the support panel and a step in the upper hook part 17*a,* or vice versa. All parallel guides next to one another may be used for the lock 109/110, in particular a) extensions 106 and grooves 105 b) upper hook part 117*a* or clamping device 17 and support extension 107 (FIG. 19, FIG. 20)

c) upper hook part 17*a* and upper part of the support panel 16.

Parallel guides are the side walls 106, 105, 17*a*, 17, 107, 16. Support panels 16 are panels which optionally hold a cover 10 at the front and, by means of hooks 18 and backward have a device 21/20/104/100 for holding by a mounting device. It is also possible to transfer heat from a heat exchanger 12 through this support panel to the cover 10 by radiation from a distance away or direct contact with thermal conduction.

In this example, the support panel 16 has, in its upper part, a recess 16*a* which is described in FIGS. 14 and 12. The support panels 16 may be mounted on one side or on both sides of a heat exchanger 12 and optionally also laterally. The support part 102 is preferably longer than the clamping part 17 and clamps, or is guided, between groove 101 and groove 104.

An extension 109 which may be in the form of a step is shown on the right and left. The step or the extension 109 may also be formed on the support extension 107, and the recess 108 or the support point 110 on the upper hook part 117*a*. It is also possible to form the lock 109/110 in the extension 106-groove 105 connection, it being unimportant whether the extension 106 is formed from the upper hook part 17*a* or from the clamping device 17 or on the left or right and/or on both sides.

The step 109 and the support point 110 may have different shapes, for example also oblique, as shown here, and they may be formed to be continuous or point-like. If the hook 18 is anchored in the groove 19 of the lining 10 and if the upper hook part 17*a* is adjusted by a screw 8 with a clamping device relative to one another, the clamping device 17 is raised on or pressed against the oblique extension 100. The support extension 103 is supported on the support panel 16 and is held at the bottom in the groove 104. Thus, 100% alignment of the clamping device 17 and consequently also of the upper part 17*a* with the support panel 16 is achieved.

By supporting the upper hook part 17*a* on the support extension 107, which is supported at least with its open end on the upper hook part 17*a* (or vice versa), the hook 18 is not excessively tilted by the tolerances of the guide parts. The tolerances may result during manufacture and are also advantageous during assembly (pushing onto the support panel 16).

In another embodiment, the groove 105, the extension 106 and the support extension 107 may be formed not continuously but, for example, only in the middle of the parts 17, 17*a* or on both sides.

In a particular embodiment, a two-part clamping part, consisting of upper hook part 17*a* and clamping device 17, horizontally guided on a support panel 16, is formed for holding a lining 10 in a desired position of the upper hook part 17*a* in at least two [lacuna] in the parallel guides 106/105/17*a*/107/17*a*/17. It has at least one extension/one step 109, optionally a web or an extension/step 109 formed in a recess 108 (FIGS. 19, 20).

In a further particular embodiment, the height of the parallel guide determined by the extension-groove connection 106/105 is increased by the height/depth of the support extension 107 by the formation of a support extension 107 mm (FIGS. 19, 20). In a particular embodiment, the support extension 107 is higher/lower than the upper hook part 17*a* or the clamping device 17, from which it is formed (FIGS. 19, 20).

In a particular embodiment, the clamping device 17 has a lengthening part 103 which raises the support surface 102 to a support panel 16 and thus reduces the danger of tilting.

In a particular embodiment, the lengthening part 103 is guided in the lower region in a groove 104 of the support panel 16 (FIGS. 19, 20).

In a variant, the support extension 107 is formed a) on the clamping device 17 b) from the upper hook part 17*a* (FIGS. 19, 20).

In another particular embodiment, the hook 18 has a preferably rounded support surface 111 and/or a space 112, the support surface 111 being formed from the hook 18 and a) consisting of a material which differs from that of the hook 18, preferably of resilient and/or flexible material;

b) the hook itself is formed to be resilient.

In a further particular embodiment, a) the hook 18 itself or b) the total clamping device 17 consists of a resilient material (FIGS. 19, 20).

In a further particular embodiment, the extension 100 of the support panel 16 is obliquely formed.

FIG. 20 shows a two-part clamping part according to FIG. 19 and, on the right, a support panel 16. Here, however, the support extension 107 is formed from the upper hook part 17*a* and the extension 106 from the clamping device 17. The groove 105-extension 106 connection is formed in a manner opposite to that in FIG. 19, as is the lock 109/110.

The lock 109/110 may also be mounted in the extension 106/groove 105 formation, on the left, on the right or on both sides.

If at least the clamping device 17 is formed from plastic or parts thereof are used as springs, etc., the two-part clamping part can be snapped by means of a groove 101 onto an extension 100 of the support panel 16, for which purpose prior resting of the support surface 103 in the groove 104 is expedient. A possible snap part 101*a* may be formed at the bottom or top and may have different shapes, as also the formation of the groove 101 and of the extension 100.

The recess 108 may also be provided in the clamping device 17, as in the upper hook part 17 in FIG. 19. The lower part of the support extension 107 (in FIG. 19, the upper part of the support extension) may be formed lower or thicker at the end of the support surface for the clamping device 17 (in FIG. 19, upper hook part 17*a*) and form an almost 100% parallel guide to the extension-groove guide 105/106.

Conversely, the support surface of the upper hook part 17*a* at the bottom or the lower part of the clamping device 17 may be formed thicker. As a result of a more or less thick formation of these parts, the angle of the upper hook part 17*a* can be influenced, since the upper hook part 17*a* and the clamping device 17, for example produced from extrusion materials, the parallel guide 105/106 cannot be 100% accurate and have tolerances [sic]. Preferably, a pressure spring or spring ring, etc. is mounted between screw head 8 and upper hook part 17*a* in order to compensate expansions of the support panel 16, optionally in combination with a blind hole in the clamping device 17.

FIG. 23 top: shows a rail 1 from above (see FIG. 24A to 24C) with grooves 6 on both sides and central screw channel 8*a*. These rails 1 must be immovably and exactly butt-jointed in the case of floor or base mounting (also brackets), so that operation of the rails 1 is maintained. This means that the fastening and the joining of two rails are effected by means of screws 8 in the screw channel 8*a*. For this purpose, a reinforcing metal sheet 8*f* (shaded) for example of sheet metal or plastic and having two preferably elongated holes 8*e* (in the longitudinal direction), is fixed by means of bolts 8, etc. in the screw channel 8*a*. This bolt/nut fastening, for example, makes it possible to move and also to position the mounting parts 2 by means of these fastening parts. Bottom: longitudinal section.

Such a connection of two strips 1 is also advantageous in the case of angle embodiments.

FIGS. 24A to 24C show a rail 1 which is fastened by, for example, screws 8. The screw channel 8*a* and the grooves 6 may have different shapes, also in the majority or as an extension. In order to save mounting parts 2 or as a necessary addition for positioning the support surface 3, such a support surface 3 with the same support height of the mounting part 2 is equipped with extensions on both sides—continuous or point-like—which project into the grooves 6 of the rail 1 and may also be formed to clamp. A plug connection with the screw channel 8*a* is also possible.

The support surface 3 may also have lateral parts which form a guide with the rail 1 and may also be formed to clamp. The support surface 3 is preferably as broad as the rail 1 but may also be as broad as the mounting part 2.

The support surface may have at least one passage in its surface and may consist of various materials (metal, plastic, etc.).

In the rear part of the rail 1, two pipes 13*a* (of a heat exchanger or pipelines, etc.) are arranged above the rail 1. Throughout a relatively long heating system and also at inner and outer corners, it is necessary from case to case to mount fixing points for the expandable hot water pipes. For this purpose, it is necessary to mount or to insert at least one upright 13*b* or parts thereof in the screw channel 8*a* or in the grooves 6 or in the rail 1 in a nondisplaceable manner, in the lower part optionally also provided with a ring 105 (as a support part), or with thread or nut fixing systems.

Mounted in the upper part of the upright 13*b* is a beam 13*h* which has pipe clamps 13*b* formed on both sides, which clamps hold or clamp the pipes 13*a*. By using a fixed point by means of upright 13*b* in a nondisplaceable connection with a rail 1, it is possible to compensate thermal expansions of the pipes/pipelines or of the heat exchanger by means of compensators, for example flexible pipes, etc.

The beam 13*h* may be formed in one piece or in a plurality of pieces and has pipe clamps 13*c* on both sides for at least one pipe 13*a;* the pipe clamps 13*c* may also be formed merely as clips and may also be fastened to the pipes by screw means.

In another embodiment, the upright 13*b* can be partially or completely enclosed by side parts on the rail 1 and thus held.

The pipe clamp 13*c* may also partially or completely enclose a heat exchanger 12.

In another embodiment (in the upper part of the Figure, shown in plan view), a slot 8*e* and optionally a slit 8*g* are formed in the beam 13*h*. The slit 8*g* facilitates the insertion of an upright 13*b* which should then be fastened to the beam only by a nut or a screw head, etc. from above and preferably a nut or a clamping part from below.

With the use of a lower and of an upper beam 13*h* with pipe clamps 13*b* mounted at the ends and a slit 8*g* provided in the beam 13*h,* it is also possible, for reasons of stability, to position the beams 13*h* one on top of the other so that the pipes are clamped between two beams 13*h* and the lower beam 13*h* has the slit 8*g* arranged on the right and the upper beam 13*h* has the slit 8*g* arranged on the left, or vice versa.

The upright 13*b* (also formed from threaded rods, etc.) may readily be threaded or mounted with nuts, washers, etc. at the top and/or bottom, which would be difficult in the absence of the slit 86, owing to the lack of space. The two beams are preferably identically formed, which helps to save tool costs. The two beams 13*a* may have snap/plug means, or said means can be mounted. The pipe clamps may have slits, grooves or extensions on both sides, which then hold together at the rear the plastic parts, rings, rubber rings, etc., at least during assembly.

If fixing of the pipes 13*a* is not necessary but only guidance of the pipes or of the heat exchanger formed thereon in the longitudinal direction, so that lateral slipping is not possible, at least one beam 13*h* is provided which is arranged either below or above the pipes 13*a* and has extensions (bends) on both sides, which hold the pipes in guide holders from the outside or from the inside. Furthermore, the beam 13*h* may be positioned between the pipes and can thus form a guide, correspondingly formed support surfaces being provided on both sides. The contact points with the pipes or sockets, pipe bends, etc. must be formed so that tilting is not possible.

The embodiment of the upright 13*b* or beam 13*h* can also be used in heating systems without rails, for example in underfloor convectors. In this case, the hole for the upright 13*b* is provided in the base of the convector, insertion of the upright 13*b* into this hole preferably being sufficient. Instead of fastening to the beam 13*h,* merely a guide channel with, for example, approx. 10 mm height is also possible. In the case of such fastened or only inserted uprights 13*b* in the beam 13*h,* the upright 13*b* is merely inserted into a suitable hole in the screw channel 8*a,* even without additional fastening from below.

A connection of the upright 13*b* to the beam 13*h* can also be effected by clamping or by the plug method; furthermore, the upright 13*b* can be permanently connected with at least a part of the total beam 13*h*.

In a rail embodiment without screw channel 8*a,* upright 13*b* and rail 1 are connected, for example, only by a hole in the rail 1 with or without screw connections.

In a particular embodiment, the support surface 3, preferably at the same height as the support surface 3 of the mounting part 2, a) comprising two extensions 5 loose or clamping in the grooves of the rail 1,
b) can be inserted by means of at least one web in the screw channel 8*a* or
c) surround [sic] the rail 1 with two side parts.

In a further particular embodiment, at least one pipe clamp 13*c* or a mounting device for heat exchanger 12 of a variety of designs or shapes, with or without beam 13*h* has a plug or screw connection with the rail 1 by means of an upright 13*b* via a) the screw channel 8*a;*
b) the groove 6;
c) the rail 1;

or the upright 13*b* partially or completely encloses the rail.

FIGS. 25A and 25B, left, shows a heating system according to FIGS. 24A–24C, but without support surface 3 with extensions 5, in side view. The heat exchanger 12 which is held by an upright 13*b* at a fixed point is shown. A support surface 3 is formed on the upright 13*b* and an electric cable 13*d* from the pipe 13*a* is shown in order to demonstrate that electric heating systems, too, can be mounted in this manner. Such heating systems described in all Figures can also be electrically operated.

On the right: fixing system in cross-section.

FIG. 26 shows a heating system according to FIGS. 1/1A/2/3/4/6, which is lined with wood or the like. In side view, a front or a rear lining 10 is held by a mounting part 2 or mounting elements 24. A side lining 10 which has a reinforcing part 10 is clamped between a front and a rear lining 10 (also see FIG. 27) by means of at least one plug on each side 10*p*. The plugs 10*p* are optionally round and mounted on the side surfaces of the side lining 10*n* or on a reinforcing part 10*o* on the inside of the lining 10.

A plug 10*p* is also to be understood as meaning at least one groove or tongue, indentations or extensions having point-like or elongated shapes, diametrically opposite embodiments on the insides of the lining 10 and on the side linings 10*n* or their reinforcing part 10*o,* as well as loose parts (for example plugs, fish plates, etc.) which fit into holes, slits, etc. in both lining parts.

The clamping of the sides—lining 10*n*—is effected by mounting the linings 10 on both sides. The reinforcing part 10*o* has a recess 10*r* or a space in the reinforcing part 10 which recess or space may be necessary for a pipe 13*a*. The side lining 10*n* is shown again beside the clamped side lining.

In a particular embodiment, the front and rear lining 10 is mounted or clamped by a mounting device comprising at least two holding parts 2. The mounting device is mounted or guided on a rail 1 and has, on at least one end or along the inside, on both sides, at least one plug 10*p*—connection to a side lining 10*n* or a reinforcing part 10*o* with a side lining. This therefore clamps nondisplaceably. Optionally, the reinforcing part 10*o* and the side lining have a groove 10*r* for pipes 13*a*.

FIG. 27 shows FIG. 26 viewed from above. Plugs 10*p* mounted on both sides clamp the side lining 10*n* with the linings 10. The side lining 10*n* is shown again beside the clamped side lining 10*n*.

On the left: the side lining 10*n* preferably carries prefabricated commercial plugs 10*p* having semicircular ends which are already loosely clamped or inserted in this side lining, optionally also in the reinforcing part 10*o*. The plugs 10*p* project with their semicircular part—for example, approx. 5 mm is sufficient (and is also advantageous)—and the side lining 10*n* can easily be clamped between the linings 10. In this embodiment, the lining can be provided only with diametrically opposite holes for the plugs 10*p,* preferably with the use of a template.

Vessels, troughs, grilles, mounting parts or assembly parts with a) an all-round edge directed outward b) an edge on at least both sides and directed outward c) or tabs, extensions, etc. projecting outward can be mounted on support surfaces 10*b,* on at least two sides, of the lining 10 or of the support panel 16, the support surfaces 10*b* preferably being lower than the upper edge of the lining 10 or of the support panel 16. The support surfaces 10*b* optionally also have a continuous groove and/or a continuous extension and cooperate with supporting edges, tabs, extensions, etc. of parts to be placed on top or suspended. In another embodiment: thin lining 10 (marble slab, etc.) which are [sic] mounted on support panels 16 are [sic] provided with continuous or sectionally arranged support surfaces 10*b* to be suspended in or on the lining 10, these can also be produced preferably from transparent plastic, metal, wire, etc.

FIGS. 28A–28C shows an embodiment according to FIG. 27. Here, the side lining 10 and the lining 10 is cut in a bevel, and a support surface 10*b* is provided. The lateral lining 10*n* interlocks as a result of the two-sides plug connection with the lining 10. These complete constructions are also formed as containers/coverings. The support surface 3, the mounting parts 2 as well as the support surfaces 3 from FIG. 24 the support surfaces for inserted or mounted-in bases, claddings, grilles, perforated plates, troughs, etc.. For example, such containers are also formed for plants, xerophites, flower arrangements, etc. and are used as room dividers, decorative objects, etc. and can also be used in this manner in all lengths and angle embodiments. These container need not be permanently mounted on the floor/wall and can optionally have castors or rolling means on the rail 1 or the bases.

FIG. 28*a* left/right cross-section—viewed from above—shows fastening of a lateral lining 10*n* according to FIGS. 26–28, but in this case the lateral lining 10*n* is clamped between lining 10 and wall or mounting part 2 and preferably locked by a locking extension 10*n*.

On the left: A mounting part 2 is mounted on a wall, a lateral lining 10*n* (shown a distance away) has a reinforcing part 10*o* (screwed on, in slit 8, adhesively bonded, etc. or formed as one piece with the lateral lining 10*n*). At least one plug 10*p,* etc. is preferably placed in the reinforcing part 10*o*. Shown a distance away is a lining 10 with recess 107, etc. for locking by means of the plug 10*p*. In all such embodiments (including FIGS. 26 to 28A–28C), the front lining 10 may cover the lateral lining 10*n,* or vice versa, but it is simpler for the lateral lining to cover the lining 10. Thus, the grooves 19 (in an embodiment with grooves) are concealed and the side lining 10*n* with reinforcing part 10 and optionally locking extension (prefabricated) can be mounted on site.

On the right: as on the left, however the lining 10 is mounted and clamps the lateral lining 10*n* and the reinforcing part 100, the locking extension 10*n* locking the clamping means, and the lateral lining 10*n* can be released by removing the lining 10.

FIG. 28B shows a mounting part 2 with arms for holding the lining 10 (mounting for the lining not shown). The lateral lining 10*n* has a reinforcing part 10*o*. This preferably has a locking extension 10*n* mounted on it or is formed integrally with said locking extension. During assembly, the lateral lining 10*n* is held with the reinforcing part 10*o* in the correct position on the mounting part 2 and the lining 10—now shown a distance away—is pressed with its recess 107 onto the plugs 10*p* (or vice versa, or by means of loose plugs) and the lining 10 is mounted.

The locking extension 10*a* is positioned to the side of the mounting part 2 and locks this clamping connection. If the locking extension is not used, the reinforcing part 10*o* clamps the mounting part 2.

In yet another embodiment, the reinforcing part 10*o* rests against the wall and thus increases the support surface. For exact mounting and a good result, it is preferable for the reinforcing part 10*o* to rest on the mounting part 2, so that even uneven walls do not hinder the mounting.

FIG. 29 left: shows a fastening part 114 for pushing or snapping into the grooves 25*a* (FIG. 11). These fastening parts 114 may be formed rigid or springy and have an insertion orifice 115 in the upper region and optionally a slight bend 116. This fastening part 114 may have various shapes and may be produced from various materials, for example from sheet metal, plastic, etc.

Middle: shows a fastening part 114 into which an air guide plate 117 (heat/cold shields, etc.) has been inserted. In the lower part, the air guide plate 117 has a bend 116, which may be desired for a specific air guidance. Right: shows a lining 10 in relation to the air guide plate 117 which also has an optionally formed bend 116. To be able to insert the air guide plate from above, a slit 8*g* is formed or can easily be provided on site. Through the slit 8*g,* the bend 116 to the mounting part 2 is optionally also formed. The air guide plate can be produced from various materials, metal, plastic, etc.

The list of reference symbols is an integral part of the description of the Figures.

REFERENCE SYMBOLS

1 Rail
1*a* Feet/Rail
1*b* Holes/Rail
2 Mounting part
3 Support surface for heat exchanger
4 Side parts
4*a* Claw
4*b* Lower part
4*c* Side part
4*d* Hook part offset inward
4*e* Upper part
4*f* Support surface/Side part
5 Extension/Lower part 4*b*
5*a* Groove/Lower part 4*b*
6 Groove/Rail
7 Extension/Rail
8 Screw
8*a* Screw channel
8*b* Lateral notch
8*c* Hole/Base
8*d* Side wall/Channel
8*e* Slot
8*f* Reinforcing plate
8*g* Slit
9 Lengthening part
10 Lining
10*a* Low lining
10*b* Support surface for grille
10*n* Side lining
10*o* Reinforcing part
10*p* Plug
10*r* Recess for pipe/pipeline
10*s* Ring
10*t* Recess for plug
10*u* Locking extension
11 Ventilation grille
12 Heat grille
13 Support part
13*a* Pipe
13*b* Upright
13*c* Pipe clamp
13*d* Electrical cables/-en [sic]
13*f* Lamellae
13*g* Connecting part
13*h* Beam
14 Convection orifice
15 Base
15*a* Passages
16 Support panel
16*a* Recess/Support panel
16*b* Support surface/Support panel
17 Clamping device
17*a* Upper hook advantage [sic]
17*f* Guide part
17*h* Recess
18 Hook, top/bottom
18*a* Lower hook for lining
18*b* Groove/upper hook 21
18*c* Extension/hook part offset inward
18*d* Support extension
19 Grooves/Lining
20 Hook/lower support panel
21 Hook/upper support panel
21*a* Lower hook/lengthening part
22 Thick parts
23 Space
24 Mounting elements
25 Groove/Support panel
25*a* Groove/Side part
25*b* Oblique extension/lower part
26 Inserted part
26*a* Web/Inserted part
27 bracket
28 support part/support panel
29 setscrew
100 extension
101 groove/clamping device
101*a* snap part
102 support surfaces
103 support extension
104 groove
105 groove
106 extension
107 support extension
108 recess
109 extension/step
110 support surface/support extension
111 support surface/hook
112 space
113 hook/support surface
114 fastening part
115 insertion orifice
116 bend
117 air guide plate

What is claimed is:

1. A mounting system for a furnishing or room thermostat system having a mounting, a furniture part or heat exchanger and a cover, the mounting comprising a U-shaped support which holds the furniture part or heat exchanger as well as the cover on legs projecting in a U-shape, wherein a rail on which the mounting is continuously laterally displaceable and guided by at least one interlocking extension-groove-joint between the rail and the mounting so that the mounting is held in an interlocking nondisplaceable manner in a plane essentially at right angles to the displacement direction is coordinated with the mounting on its lower side.

2. The system as claimed in claim 1, wherein at least two U-shaped mounting parts (2) open upward or to the side, for at least one furniture part, heat exchanger (12) or heating accessory, pipes, are provided with rigid side parts (4) arranged on both sides of the mounting parts.

3. The system as claimed in claim 1, wherein the mounting has mounting devices (4*a*/24/17*a*/18/17*h*/4*d*/21*a*) for holding linings (10/10*a*) or support panels (16), and wherein a continuous rail-like system, namely the at least one extension (5)—groove-joint is coordinated, in the middle or at the side of the rail (1), with linings (10/10*a*) or support panels (16) on the lower parts (4*b*) of the mounting parts facing the floor.

4. The system as claimed in claim 1, wherein the rail (1) is narrower than the total lower part (4*b*) of the mounting part (2) and not more than 80% of the width of the total lower part (4*b*) and wherein, optionally, guiding of the rail is realized by two extension-groove-joints (5/7).

5. The system as claimed in claims 1, wherein the mounting part a) can be pushed on only at the end or beginning of the rail (1) and b) can be fastened (Fig. A).

6. The system as claimed in claim 1, wherein the mounting parts (2)

can be snapped/clamped on the rail (FIGS. 1, 2, 3, 4, 5, 6, 7, 8, 9, 10, 11A).

7. The system as claimed in claim 1, wherein the mounting parts (2) are arranged at intervals on the rail (1) and the rail (1) is mounted on a base which is selected from the group consisting of:

a continuous base (15), optionally with passages (15*a*);

bases (15) arranged at intervals or brackets projecting from the wall;

and a floor or a wall] (FIGS. 4, 1A, 1, 2, 3, 5, 8, 9, 10).

8. The system as claimed in claim 1, wherein the rail (1) is formed integrally with a continuous base (15) or can be connected to the continuous base.

9. The system as claimed in claim 1, wherein the mounting has a lower part (4*b*) with at least one further lower part (13) which, at its lowest point, is just as low as the rail (1) (FIGS. 11, 9, 7, 10, 6, 3, 1A).

10. The system as claimed in claim 1, wherein a side part (4) formed by a leg of the mounting and facing a wall/glass surfaces has a hook (4*a*) for a support panel (16) and lining (10) or only a support panel (16) or a lining (10), which is so short that a convection orifice or a passage (15*a*) if formed between a floor and a lower part of the lining (10*a*) or support panel (16) (FIGS. 5, 3).

11. The system as claimed in claim 1, wherein at least a rail-like system in a lower part (4*b*) of the mounting part (2) or of the rail (1) or both together are resiliently formed and both can be snapped together (FIG. 1).

12. The system as claimed in claim 1, wherein lining parts (10/10*a*) and optionally also a support panel (16) is formed longer, lower, higher, optionally to the floor or to a wall, on one or both sides of the mounting (FIGS. 1, 1A, 2, 3,4,5,6,7, 11, 11A).

13. The system as claimed in claim 1, wherein side parts (4) formed by legs of the mounting have a lengthening part (9) which lies along the line of the lower part of the rail (1) (FIGS. 1, 2, 5,6, 7, 1A, 11, 11A, 3, 4).

14. The system as claimed in claim 1, wherein a channel (8*a*) for a fastening element is formed between the mounting part (2) and rail (1), which channel is arranged a) in the mounting part (2);

b) in the rail (1); or c) partially in the mounting part (2) and the rail (1) (FIGS. 1, 2, 3, 5, 6, 8, 9, 10).

15. A mounting system for a furnishing or room thermostating system having a mounting, a furniture part or heat exchanger and a cover, the mounting comprising a U-shaped support which holds the furniture part or heat exchanger as well as the cover on legs projecting in a U-shape, wherein a rail on which the mounting is laterally displaceable and held in an interlocking nondisplaceable manner in a plane essentially at right angles to the displacement direction is coordinated with the mounting on its lower side, and wherein a side part (4) formed by a leg of the mounting and facing a wall/glass surfaces has a hook (4*a*) for a support panel (16) and lining (10) or only a support panel (16) or a lining (10), which is so short that a convection orifice or a passage (15*a*) is formed between a floor and a lower part of the lining (10*a*) or support panel (16) (FIGS. 5, 3).

* * * * *